US008064795B2

(12) United States Patent
Shimoyama et al.

(10) Patent No.: US 8,064,795 B2
(45) **Date of Patent: *Nov. 22, 2011**

(54) ELECTROPHOTOGRAPHIC IMAGE FORMING APPARATUS AND PROCESS CARTRIDGE

(75) Inventors: Keisuke Shimoyama, Numazu (JP); Eiji Kurimoto, Numazu (JP); Michitaka Sasaki, Chiba (JP); Shin-ichi Kawamura, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/776,704

(22) Filed: May 10, 2010

(65) Prior Publication Data

US 2010/0260515 A1 Oct. 14, 2010

Related U.S. Application Data

(63) Continuation of application No. 11/519,099, filed on Sep. 12, 2006, now Pat. No. 7,747,197.

(30) Foreign Application Priority Data

| | | |
|---|---|---|
| Sep. 13, 2005 | (JP) | 2005-264722 |
| Sep. 14, 2005 | (JP) | 2005-266245 |
| Sep. 15, 2005 | (JP) | 2005-267953 |
| Sep. 15, 2005 | (JP) | 2005-267955 |
| Sep. 15, 2005 | (JP) | 2005-269167 |
| Sep. 16, 2005 | (JP) | 2005-271006 |
| Sep. 16, 2005 | (JP) | 2005-271016 |

(51) Int. Cl.
*G03G 21/16* (2006.01)
*G03G 15/00* (2006.01)
*G03G 5/06* (2006.01)

(52) U.S. Cl. ..... 399/116; 399/159; 430/58.5; 430/59.5; 430/78

(58) Field of Classification Search ..... 430/58.5, 430/59.5, 78; 399/116, 159
See application file for complete search history.

(56) References Cited

U.S. PATENT DOCUMENTS

| | | | | |
|---|---|---|---|---|
| 5,047,803 | A * | 9/1991 | Kanoto | 399/111 |
| 5,468,583 | A | 11/1995 | Gruenbaum et al. | |
| 6,014,532 | A | 1/2000 | Takeichi et al. | |
| 6,124,067 | A | 9/2000 | Mikuriya et al. | |
| 6,330,011 | B1 * | 12/2001 | Taira et al. | 347/131 |
| 7,747,197 | B2 * | 6/2010 | Shimoyama et al. | 399/159 |
| 7,871,747 | B2 * | 1/2011 | Shimoyama et al. | 430/64 |
| 7,919,220 | B2 * | 4/2011 | Shimoyama et al. | 430/78 |
| 2002/0051654 | A1 | 5/2002 | Niimi et al. | |
| 2003/0134220 | A1 | 7/2003 | Emoto et al. | |
| 2004/0033428 | A1 | 2/2004 | Niimi | |
| 2004/0146309 | A1 | 7/2004 | Shu et al. | |
| 2007/0219375 | A1 | 9/2007 | Fujiyama et al. | |
| 2008/0305426 | A1 | 12/2008 | Kurimoto et al. | |

FOREIGN PATENT DOCUMENTS

| | | |
|---|---|---|
| JP | 57-122444 | 7/1982 |
| JP | 01-206349 | 8/1989 |
| JP | 02-148059 | 6/1990 |
| JP | 05-142812 | 6/1993 |
| JP | 2001-042554 | 2/2001 |
| JP | 2004-163497 | 6/2004 |
| WO | 2005/092901 | 10/2005 |

OTHER PUBLICATIONS

Diamond, A.S., ed., Handbook of Imaging Materials, Marcel Dekker, Inc., NY, pp. 395-396 (1991).

* cited by examiner

*Primary Examiner* — Janis L Dote
(74) *Attorney, Agent, or Firm* — Oblon, Spivak, McClelland, Maier & Neustadt, L.L.P.

(57) ABSTRACT

An electrophotographic image forming apparatus, including a photoreceptor, a charger charging the surface of the photoreceptor, an irradiator irradiating the surface of the photoreceptor with imagewise light to form an electrostatic latent image thereon, an image developer developing the electrostatic latent image with a developer including a toner to form a toner image on the surface of the photoreceptor, and a transferer transferring the toner image onto a transfer material, wherein the photoreceptor includes an electroconductive substrate, and a photosensitive layer overlying the electroconductive substrate and including a charge generation material and a specific charge transport material.

12 Claims, 4 Drawing Sheets

ELECTROPHOTOGRAPHIC IMAGE FORMING APPARATUS AND PROCESS CARTRIDGE

This is a continuation application of U.S. application Ser. No. 11/519,099, filed Sep. 12, 2006 now U.S. Pat. No. 7,747, 197.

BACKGROUND OF THE INVENTION

1. Field of the Invention

The present invention relates to an electrophotographic image forming apparatus using a photoreceptor including a specific charge transport material, and to a process cartridge including the photoreceptor.

2. Discussion of the Background

Recently, development of information processing systems utilizing electrophotography is remarkable. In particular, optical printers in which information converted to digital signals is recorded using light have been dramatically improved in print qualities and reliability. This digital recording technique is applied not only to printers but also to copiers, and so-called digital copiers have been developed and used. Copiers utilizing both the conventional analogue recording technique and this digital recording technique have various information processing functions, and therefore it is expected that demand for such copiers will be escalating. In addition, with popularization and improvement of personal computers, the performance of digital color printers which can produce documents.

In place of conventional inorganic materials such as Se, CdS and ZnO as photoconductive materials for electrophotographic photoreceptors, organic photoconductive materials having better sensitivity, thermostability and nontoxicity than the inorganic materials are now prevailing. Most of the electrophotographic photoreceptors using the organic photoconductive materials have functionally-separated photosensitive layers formed of charge generation layers including charge generation materials and charge transport layers including charge transport materials.

On the other hand, a single-layered photoreceptor including a charge generation material and a charge transport material in a single photosensitive layer now attracts attention because it can be prepared by a simple process, optical properties improve due to fewer layer interfaces and it can be used for either a positive or a negative charging process.

Typically, an electrophotographic image forming apparatus irradiates writing light modulated by image data onto a uniformly charged photoreceptor to from an electrostatic latent image thereon; and provides a toner to the photoreceptor from the image developer to develop the electrostatic latent image to form a toner image thereon.

As charging methods in the electrophotographic image forming apparatus, a corona charging method using a metallic wire and contact charging method contacting a charging roller to the photoreceptor, etc. are known.

The contact charging method produces less oxidizing gases such as ozone and NOx than the corona charging method because a lower voltage can be applied to the charging member of the contact charging method than that applied to that of the corona charging method. However, the contact charging method having high discharge energy gives a large stress to a photoreceptor and the photoreceptor is abraded faster, has poor charge followability when the process linear speed becomes faster and the photoreceptor tends to have discharge breakdown because a high voltage is directly applied thereto.

The corona charging method having good charge following capability and less electrostatic stress to a photoreceptor, and therefore is advantageous for higher speed and durability of the apparatus, but produces more oxidizing gas such as ozone and NOx (about 100 times as much as that produced by the contact charging method).

When a photoreceptor is exposed to an oxidizing gas such as ozone and NOx, a charge generation material and a charge transport material in a photosensitive layer thereof are oxidized, which causes decrease of chargeability, increase of residual potential and deterioration of sensitivity thereof, resulting in production of images having low image density and foggy images.

In order to solve these problems, Japanese Laid-Open Patent Publication No. 57-122444 discloses a method of including an antioxidant in the photosensitive layer. However, when an antioxidant is included therein, there are adverse effects of increase of residual potential and deterioration of sensitivity thereof from the beginning or when repeatedly used, resulting in insufficient durability thereof.

Because of these reasons, a need exists for a photoreceptor without deterioration such as decrease of chargeability due to an oxidizing gas which is massively produced when the corona charging method is used, which is capable of preparing a high-speed and high-durability electrophotographic image forming apparatus.

SUMMARY OF THE INVENTION

Accordingly, an object of the present invention is to provide an electrophotographic image forming apparatus including a photoreceptor which is not deteriorated by an oxidizing gas even when using a corona charging method for high-speed and high-durability of the apparatus, and producing high-quality images for long periods.

This object and other objects of the present invention, either individually or collectively, have been satisfied by the discovery of an electrophotographic image forming apparatus, comprising:

- a photoreceptor,
- a charger charging the surface of the photoreceptor,
- an irradiator irradiating the surface of the photoreceptor with imagewise light to form an electrostatic latent image thereon,
- an image developer developing the electrostatic latent image with a developer comprising a toner to form a toner image on the surface of the photoreceptor, and
- a transferer transferring the toner image onto a transfer material;

wherein the photoreceptor comprises:

- an electroconductive substrate, and
- a photosensitive layer located overlying the electroconductive substrate, comprising a charge generation material and a charge transport material having the following formula (A):

(A)

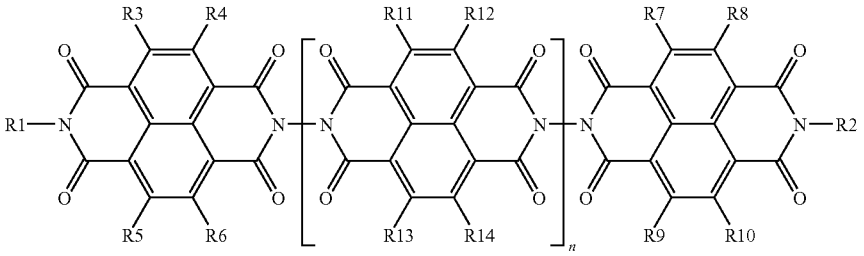

wherein R1 and R2 independently represent a hydrogen atom, and a group selected from the group consisting of substituted or unsubstituted alkyl groups, substituted or unsubstituted cycloalkyl groups and substituted or unsubstituted aralkyl groups; R3, R4, R5, R6, R7, R8, R9, R10, R11, R12, R13 and R14 independently represent a hydrogen atom, a halogen atom, and a group selected from the group consisting of cyano groups, nitro groups, amino groups, a hydroxyl groups, substituted or unsubstituted alkyl groups, substituted or unsubstituted cycloalkyl groups and substituted or unsubstituted aralkyl groups; and n is repeat unit and represents 0 and an integer of from 1 to 100, wherein the transferer comprises an intermediate transferer, wherein after the toner image is primarily transferred onto the intermediate transferer, the toner image is secondarily transferred onto a recording material., and wherein the intermediate transferer comprises a belt, and the toner image formed on the photoreceptor is transferred onto said belt b a first transferrer located inside said belt.

In another embodiment, the electrophotographic image forming apparatus further comprises a plurality of the photoreceptors, wherein one-color toner images developed on each of the photoreceptors are overlaid in order to form color images.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
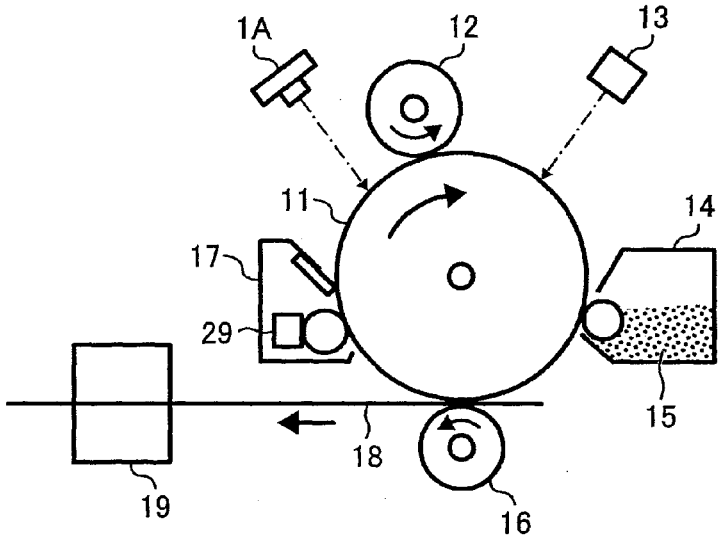
FIG. 1 is a schematic view illustrating a partial cross-section of an embodiment of the image forming apparatus of the present invention.

The present invention provides a high-speed and high-durability electrophotographic image forming apparatus producing high-quality images for long periods.

Specifically, an electrophotographic image forming apparatus, comprising a photoreceptor, a charger charging the surface of the photoreceptor, an irradiator irradiating the surface of the photoreceptor with imagewise light to form an electrostatic latent image thereon, an image developer developing the electrostatic latent image with a developer comprising a toner to form a toner image on the surface of the photoreceptor, and a transferer transferring the toner image onto a transfer material, wherein the photoreceptor comprises an electroconductive substrate, and a photosensitive layer located overlying the electroconductive substrate, comprising a charge generation material and a charge transport material having the above-mentioned formula (A) produces high-quality images at high speed.

In the present invention, a corona charger is used. The corona charge having better high speed followability than a contact charger using a charging roller can make the electrophotographic image forming apparatus produce images at higher speed. In addition, the corona charger has less electrostatic and physical stress to the photoreceptor.

The contact charger has high discharge energy and large electrostatic stress to the photoreceptor. Further, the photoreceptor is largely abraded because the charging roller contact the photoreceptor. Therefore, the corona charger can prolong lives of photoreceptors.

However, the corona charger produces a massive oxidizing gas such as ozone and NOx, which causes decrease of chargeability, increase of residual potential and deterioration of sensitivity of photoreceptors.

Since the charge transport material having the above-mentioned formula (A) has good resistance to the oxidizing gas, the decrease of chargeability, increase of residual potential and deterioration of sensitivity of photoreceptors do not occur even when a massive oxidizing gas is produced by the corona discharger. The charge transport material is considered to be resistant to the oxidizing gas because of having a strong N-th basicity molecular-structurally.

In addition, since the charge transport material having the above-mentioned formula (A) has very good charge transportability, the resultant photoreceptor is not only resistant to the oxidizing gas but also highly sensitive in electrostaticity. Further, a specific charge generation material improves the properties of the resultant photoreceptor. In the present invention, known charge generation materials can be used, and particularly a charge generation material having a phthalocyanine structure is preferably used in terms of combination with the charge transport material of the present invention.

Among the phthalocyanines, a titanylphthalocyanine having titanium as a central metal and the following formula is more preferably used because the resultant photosensitive layer has sensitivity.

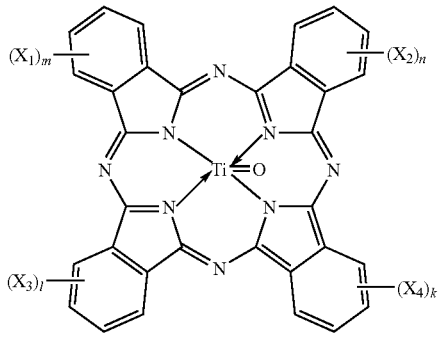

wherein $X_1$, $X_2$, $X_3$ and $X_4$ independently represent a halogen atom; and n, m, l and k independently represent 0 or integers of from 1 to 4.

Methods of synthesizing the titanylphthalocyanine and electrophotographic properties thereof are disclosed in Japanese Laid-Open Patent Publications Nos. 57-148745, 59-36254, 59-44054, 59-31965, 61-239248, 62-67094, etc.

In addition, the titanylphthalocyanines having different crystal forms are disclosed in Japanese Laid-Open Patent Publications Nos. 59-49544, 59-1669559, 61-239248, 62-67094, 63-366, 63-116158, 64-17066, 2001-19871, etc.

Further, the titanylphthalocyanine preferably has an X-ray diffraction spectrum such that a maximum peak is observed at a Bragg (2θ) angle (±0.2°) of 27.2°; or an X-ray diffraction spectrum such that a maximum peak is observed at a Bragg (2θ) angle of 27.2±0.2°, a lowest angle peak at an angle of 7.3±0.2°, and a main peak at each of Bragg (2θ) angles (±0.2°) of 9.4°, 9.6°, and 24.0°, wherein no peak is observed between the peaks of 7.3° and 9.4° as disclosed in Japanese Laid-Open Patent Publication No. 2001-19871.

Further, the titanylphthalocyanine having the above-mentioned crystal form and an average primary particle diameter not greater than 0.25 μm without coarse particles, when synthesized or subjected to a dispersion filtration treatment, as disclosed in Japanese Laid-Open Patent Publications Nos. 2004-83859 and 2004-78141 is more preferably used. A dispersion liquid having a small average particle diameter can be prepared using the titanylphthalocyanine having a small average primary particle diameter. All particles are not present in a dispersion liquid as primary particles, and some primary particles agglutinate therein. Therefore, a dispersion liquid having a small average particle diameter can be prepared using the titanylphthalocyanine having an average primary particle diameter not greater than 0.25 μm without coarse particles. When the titanylphthalocyanine has a large average particle diameter, the surface area thereof becomes small and less contacts a charge transport material, resulting in small injection efficiency of a carrier. In addition, coating defects of the photosensitive layer and charge generation layer increases, resulting in defective images such as background fouling. Therefore, the smaller the average particle diameter, the higher the sensitivity and less background fouling, particularly when the average primary particle diameter is not greater than 0.25 μm.

The particle diameter means the volume average particle diameter in the dispersion liquid (a charge generation layer coating liquid), and can be determined by a centrifugal automatic particle diameter analyzer, CAPA-700 from Horiba Ltd. The volume average particle diameter means the cumulative 50% particle diameter (i.e., Median diameter). However, by using this particle diameter determining method, there is a case where a small amount of coarse particles cannot be detected. Therefore, it is preferable to directly observe the dispersion including a charge generation material with an electron microscope, to determine the particle diameter of the crystal.

When a charge generation layer and a charge transport layer are formed on a substrate in this order, the resultant photoreceptor is a positively-charged photoreceptor. When a single-layered photosensitive layer is formed on a substrate, the resultant photoreceptor is either a positively-charged or negatively-charged photoreceptor in combination with a positive-hole charge transport material. However, it is preferable that the photoreceptor is positively charged because the photoreceptor has stable chargeability and produces less oxidizing gas (about 1/10 when negatively charged).

The charge transport material having the above-mentioned formula (A) can be synthesized by known methods. Specific examples thereof include a monoimidizing method of reacting a naphthalene carboxylic acid or its anhydride with amines and a method of controlling pH of a naphthalene carboxylic acid or its anhydride with a buffer solution and reacting the naphthalene carboxylic acid or its anhydride with diamines. The monoimidizing is performed without a solvent or under the presence of a solvent. Specific examples of the solvent include benzene, toluene, xylene, chloronaphthalene, acetic acid, pyridine, methylpyridine, dimethylformamide, dimethylacetoamide, dimethylethyleneurea, dimethylsulfoxide, etc., which do not react with a material or a product at a temperature of from 50 to 250° C. A buffer solution prepared by mixing a basic aqueous solution such as lithium hydroxide and kalium hydroxide with an acid such as a phosphoric acid is used to control pH. A carboxylic acid derivative prepared by reacting a carboxylic acid with amines or diamines is dehydrated without a solvent or under the presence of a solvent. Specific examples of the solvent include benzene, toluene, xylene, chloronaphthalene, bromonaphthalene, acetic acid anhydride, etc., which do not react with a material or a product at a temperature of from 50 to 250° C. Either of the reactions can be performed without a catalyst or under the presence of a catalyst, e.g., dehydrating agents such as molecular sieves, a benzene sulfonic acid and a p-toluene sulfonic acid can be used.

Next, the image forming apparatus of the present invention will be explained in detail, referring to the drawings.

FIG. 1 is a schematic view illustrating a partial cross-section of an embodiment of the image forming apparatus of the present invention, and the following modified example is in scope of the present invention.

In FIG. 1, a photoreceptor (11) includes at least a photosensitive layer including at least a charge generation material and a charge transport material having the above-mentioned formula (A) on an electroconductive substrate. The photoreceptor (11) has the shape of a drum, and may have the shape of a sheet or an endless belt.

Corona chargers such as corotron and corotron are used as a charger (12).

The photoreceptor (11) can positively or negatively be charged, and preferably be positively charged because it is stably charged and produces less oxidizing gas such as ozone and NOx.

Non-contact chargers located close to photoreceptors can also be used in the present invention.

The closely-located charger is a non-contact charger having a gap not greater than 100 μm between the surface of the photoreceptor and the charger. When the gap is too large, the photoreceptor is unstably charged. When too small, a residual toner on the photoreceptor contaminates the surface of the charging member. Therefore, the gap is preferably from 5 to 100 μm, and more preferably from 10 to 50 μm. According to a length of the gap, known charge wire type chargers such as corotrons and scorotrons and the contact charging members such as charging rollers, charging brushes and charging blades are separately used.

Figure 2:
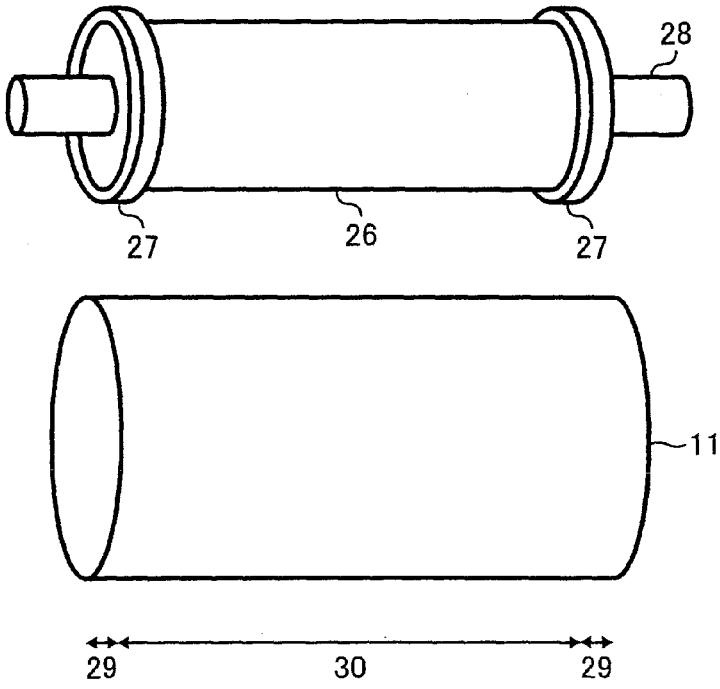
FIG. 2 is a schematic view illustrating an embodiment of a charger having a gap former, located close to a photoreceptor.

The closely-located charger for use in the present invention may have any shape provided that the gap from the photoreceptor can be properly controlled. For example, rotation axes of the photoreceptor and charging member may mechanically be fixed such that there is a proper gap. Simple methods of stably maintaining the gap include a method of using a charging roller having a gap former at both non-image forming ends thereof, which only contact the surface of photoreceptor such that the image forming area thereof does not contact the charger, or a method of locating the gap formers at both non-image forming ends of the photoreceptor, which only contact the surface of the charger such that the image forming area does not contact the charger. Particularly, methods disclosed in Japanese Laid-Open Patent Publications Nos. 2002-148904 and 2002-148905 are preferably used. An embodiment of the closely-located charger having a gap former is shown in FIG. 2, wherein numeral 26 is a charging roller, 27 is a gap former, 28 is a metallic shaft, 29 is a non-image forming end and 30 is an image forming area.

It is preferable that a DC voltage overlapped with an AC voltage is applied to the photoreceptor to reduce uneven charging. Particularly, in the tandem-type full-color image forming apparatus, the uneven charging causes a large problem of deterioration of color balance (color reproducibility) in addition to uneven density of halftone images occurred in a monochrome image forming apparatus. Overlapping an AC voltage with a DC voltage largely improves the problem. However, when properties of the AC voltage such as frequencies and peak voltages are too large, a hazard to the photoreceptor becomes large, which occasionally accelerates deterioration of the photoreceptor. Therefore, the AC voltage overlapping has to be a minimum required.

A frequency of the AC voltage varies according to a linear speed of a photoreceptor, etc., and is preferably not less than 3 kHz, and more preferably not less than 2 kHz. As for a voltage between peaks, when a relationship between an application voltage to a charging member and a charge potential of a photoreceptor is plotted, the photoreceptor has an uncharged area although a voltage is applied thereto, and the photoreceptor is not charged until it has a certain build-up potential. The most suitable voltage between peaks is about twice as much as the potential, i.e., usually from about 1,200 to 1,500 V.

However, when a photoreceptor has low chargeability or quite a large linear speed, the voltage between peaks which is twice as much as the potential occasionally comes short. To the contrary, when a photoreceptor has good chargeability, the photoreceptor occasionally shows sufficient potential stability even with a voltage between peaks which is not greater than twice as much as the potential. Therefore, the voltage between peaks is preferably not greater than three times, and more preferably twice as much as the build-up potential. When the voltage between peaks is replace with an absolute, it is preferably not greater than 3 kV, more preferably not greater than 2 kV, and much more preferably 1.5 kV.

As a transferer (16), known chargers such as a corotron, a scorotron, a solid state charger and a charging roller can be used, and a combination of a transfer charger and a separation charger is preferably used.

In one embodiment, the transferer comprises a first transferer; and an intermediate transferer, wherein the first transferer transfers the toner image onto the intermediate transferer and the intermediate transferer transfers the toner image onto the transfer material.

Suitable light sources for use in an irradiator (13) and a discharger (1A) include general light-emitting materials such as fluorescent lamps, tungsten lamps, halogen lamps, mercury lamps, sodium lamps, LEDs, LDs, light sources using electroluminescence (EL), etc. In addition, in order to obtain light having a desired wave length range, filters such as sharp-cut filters, band pass filters, near-infrared cutting filters, dichroic filters, interference filters, color temperature converting filters, etc. can be used.

In the present invention, LEDs are preferably used. The LED can make an optical system smaller than that using a polygon mirror using a LD as a light source, and can downsize the apparatus. In addition, when LEDs are arrayed in the longitudinal direction of the photoreceptor, the LED can linably write on the photoreceptor in accordance with a rotation of the photoreceptor and the writing capacity thereof is sufficiently high even when the linear speed of the photoreceptor becomes fast, i.e., at 100 mm/sec or more. Therefore, the LED can prepare a compact and high-speed apparatus.

When a toner image formed on the photoreceptor by an image developer (14) is transferred onto an image receiving medium (18), all of the toner image is not transferred thereto, and a residual toner remains on the surface of the photoreceptor. The residual toner is removed from the photoreceptor by a cleaner (17). The cleaner includes a cleaning blade made of a rubber and brushes such as a fur brush and a mag-fur brush.

Figure 3:
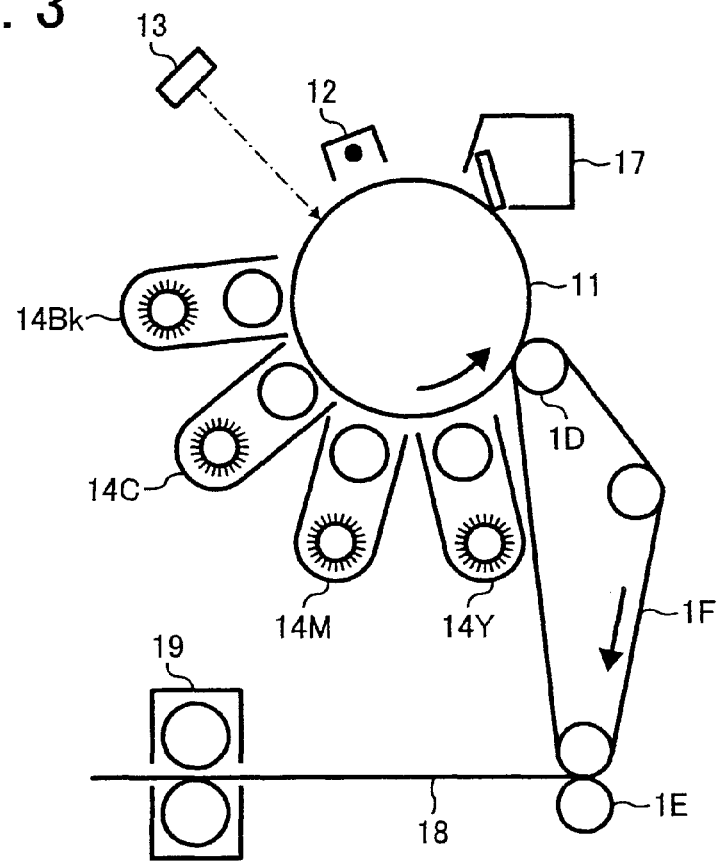
FIG. 3 is a schematic view illustrating another embodiment of the image forming apparatus of the present invention.

FIG. 3 is a schematic view illustrating another embodiment of the image forming apparatus of the present invention, wherein a charger (12), an irradiator (13), image developers (14Bk, 14C, 14M and 14Y) for each color toner (Bk, C, M and Y), an intermediate transfer belt (1F) as an intermediate transferer and a cleaner (17) are located around a photoreceptor (11).

The photoreceptor (11) is an electrophotographic photoreceptor satisfying the requirements of the present invention. The image developers (14Bk, 14C, 14M and 14Y) can independently be controlled and only the image developer forming an image works. Toner image formed on the photoreceptor (11) is transferred onto the intermediate transfer belt (1F) by a first transferer (1D) located inside the intermediate transfer belt (1F). The first transferer (1D) is located contactable to and separable from the photoreceptor (11), and contacts the intermediate transfer belt (1F) to the photoreceptor (11) only when transferring a toner image. Each color toner image overlaid on the intermediate transfer belt (1F) is transferred onto the image receiving medium (18) together by a second transferer (1E) and fixed thereon by a fixer (19). The second transferer (1E) is located contactable to and separable from intermediate transfer belt (1F), and contacts the intermediate transfer belt (1F) only when transferring a toner image.

The apparatus in FIG. 1 has an additive applicator (29) providing various additives to the surface of the photoreceptor. The additive applicator (29) can be located anywhere in the apparatus, and is preferably located at an area which does not disturb a toner image, i.e., a position where the surface of the photoreceptor passes the transferer. When the additive is a solid material, the applicator is preferably located before the cleaner because the cleaner uniformly applies the additive to the surface of the photoreceptor. Further, a combination of the applicator and cleaner is effectively used to make the apparatus compact.

Figure 4:
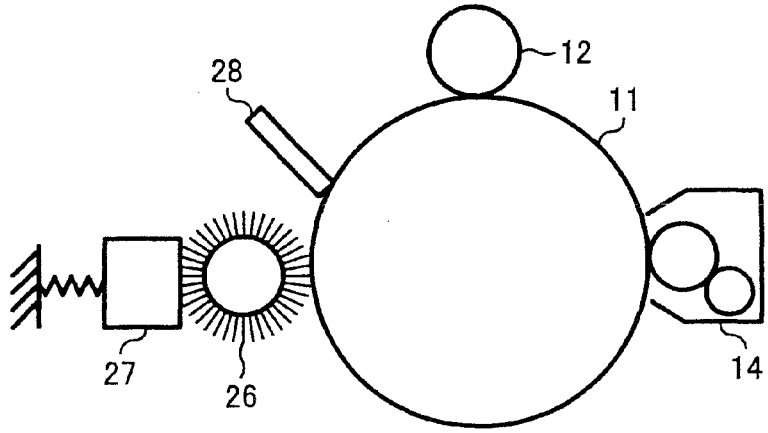
FIG. 4 is a schematic view illustrating an embodiment of an additive applicator applying an additive to the surface of a photoreceptor.

The applicator may directly press an additive (27) against a photoreceptor (11) as shown in FIG. 4, and preferably transfers the additive onto the surface of the photoreceptor (11) from a member contacting the photoreceptor (11), such as an elastic brush-shaped member (26), a blade-shaped member (28) and an elastic roller-shaped member. Particularly, the brush-shaped member (26) is preferably used in consideration of mechanical stress to the surface of the photoreceptor (11). For example, a solid additive (27) is contacted to the brush-shaped member (26) rotating to scrape a bit of the additive (27) at a time and rub the additive (27) on the surface of the photoreceptor (11).

When the additive (27) adheres to surface of the photoreceptor (11) in the state of a powder, a combination of the brush-shaped member (26) and the blade-shaped member (28) which extends the additive (27) after applying the additive (27) to surface of the photoreceptor (11), is preferably used.

As shown in FIG. 4, at least the brush-shaped member (26) is preferably located upstream of a charger (12). The brush-shaped member (26) and the blade-shaped member(28) can be combined with a cleaner cleaning a residual toner.

In addition, an additive is effectively provided through an image developer (14) as well, when the additive is mixed in a developer or included in a toner. When the additive adheres to surface of the photoreceptor in the state of a powder, a combination of the brush-shaped member and the blade-shaped member which extends the additive after applying the additive to surface of the photoreceptor, is preferably used as well.

Either of the brush-shaped member (26) and the image developer (14) has an advantage and a disadvantage. The brush-shaped member (26) can uniformly apply the additive (27) to the surface of the photoreceptor (11), but the additive (27) should be supplied thereto in time. On the other hand, the additive (27) can be supplied to the image developer (14) at the same time when a developer or a toner is supplied thereto. However, when images produced have very low image density or biased images, the additive is difficult to uniformly apply to the whole surface of the photoreceptor.

In order to utilize the advantages and supplement the disadvantages of the brush-shaped member (26) and the image developer (14), a combination thereof is effectively used.

In addition, the applicator may have a mechanism of separating from and contacting the surface of the photoreceptor. The applicator having such a mechanism will not need to constantly contact the surface of the photoreceptor, and which can prevent an excessive supply of the additive thereto, and deterioration of the applicator or the surface thereof.

Any additives uniformly adhering to the surface of a photoreceptor, protecting the surface thereof and improving the function thereof can be used in the present invention. The additive may just fulfill its function while the photoreceptor rotates once, and may be removed by a cleaner every rotation. The additive may quite thinly adhere to the surface of a photoreceptor and materials such as waxes and lubricants having extendability are preferably used.

Ester waxes or olefin waxes are preferably used in the present invention. Specific examples of the ester waxes having ester bonds include natural waxes such as a carnauba wax, a candelilla wax and a rice wax; and a montan wax. Specific examples of the olefin waxes include synthetic waxes such as a polyethylene wax and a polypropylene wax.

Specific examples of the lubricants include various fluorine-containing resins such as PTFE, PFA and PVDF; silicone resins; polyolefin resins; fatty acid metallic salts such as zinc stearate, zinc laurate, zinc myristate, calcium stearate and aluminum stearate; etc. Particularly, zinc stearate is preferably used.

In addition, an antioxidant and an UV absorber can be sued as additives to protect the surface of a photoreceptor from oxidizing gases and harmful rays. The marketed antioxidants and UV absorbers can be used as desired. When the antioxidant is included in a photoreceptor in large amount, there is an adverse effect such as increase of residual potential and the amount thereof should be limited. However, in the present invention, the antioxidant is externally added to the surface of a photoreceptor and an unnecessary quantity thereof is all removed by the blade, etc.

Figure 5:
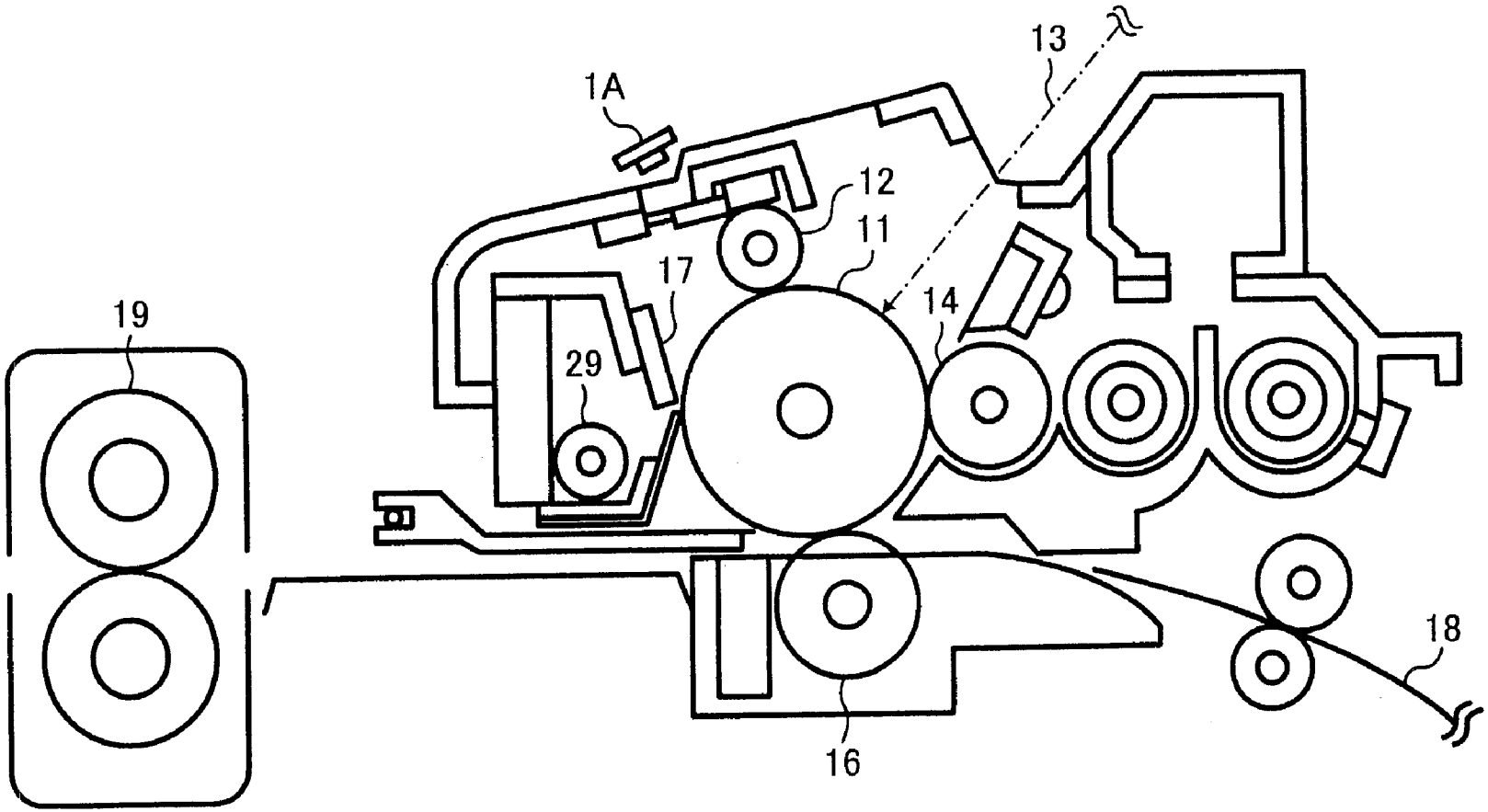
FIG. 5 is a schematic view illustrating an embodiment of the process cartridge of the present invention.

The above-mentioned image forming units may be fixedly set in a copier, a facsimile or a printer. However, the image forming units maybe set therein as a process cartridge. FIG. 5 illustrates an embodiment of the process cartridge, and not limited thereto. The process cartridge means an image forming unit (or device) including at least a photoreceptor (11) and one of a charger (12), an imagewise light irradiator (13), an image developer (14), an image transferer (16), a cleaner (17) and a discharger (1A). The photoreceptor (11) is an electrophotographic photoreceptor satisfying the requirements of the present invention.

Another embodiment of the invention is a process cartridge as described above in which the charger is a non-contact charger located such that a gap between the charger and the photoreceptor is not longer than 200 μm.

The photoreceptor of the present invention has a multilayered photosensitive layer, wherein a charge generation layer including a charge generation material and a charge transport layer including a charge transport material having the formula (A) are layered in this order, or a single-layered photosensitive layer including a charge generation material and a charge transport material having the formula (A).

Figure 6:
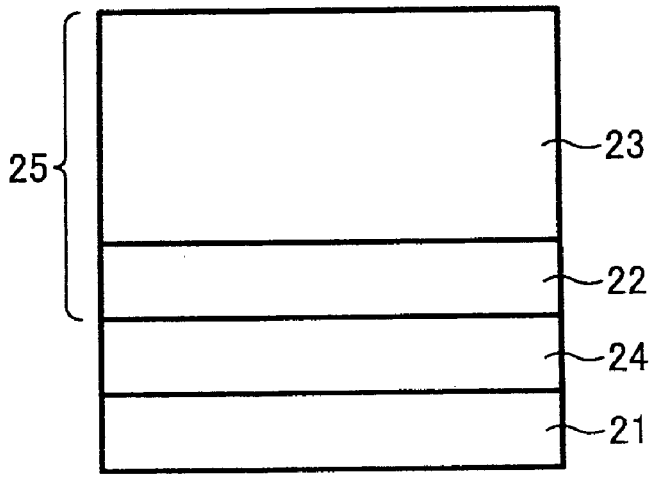
FIGS. 6 and 7 are cross-sectional views of embodiments of layer structures of the electrophotographic photoreceptor of the present invention.
Figure 7:
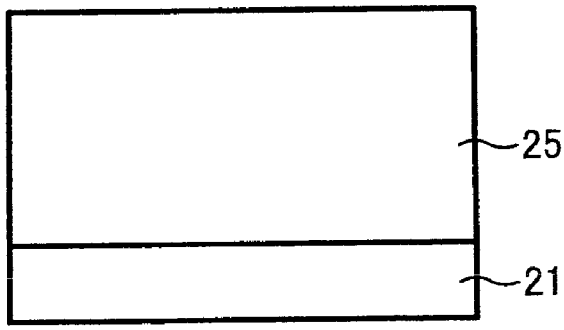

FIGS. 6 and 7 are cross-sectional views of embodiments of layer structures of the electrophotographic photoreceptor of the present invention. FIG. 6 is an embodiment of the multilayered photosensitive layer, and FIG. 7 is an embodiment of the single-layered photosensitive layer.

First, the multilayered photosensitive layer will be explained.

In FIG. 6, an undercoat layer 24 is formed between an electroconductive substrate 21 and a charge generation layer 22, and a charge transport layer 23 is formed on the charge generation layer 22.

Suitable materials as the electroconductive substrate 21 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum, etc., or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as drawing ironing, impact ironing, extruded ironing and extruded drawing, and then treating the surface of the tube by cutting, super finishing, polishing, etc. can also be used as the substrate.

The charge generation layer (CGL) 22 is a layer including a charge generation material (CGM) as a main component, and optionally a binder resin. Specific examples of the CGM include phthalocyanine pigments such as metal phthalocyanine, metal-free phthalocyanine, azulenium salt pigments, squaric acid methine pigments, azo pigments having a carbazole skeleton, azo pigments having a triphenyl amine skeleton, azo pigments having a diphenyl amine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoide pigments, bisbenzimidazole pigments, etc. These CGMs can be used alone or in combination.

In the present invention, the phthalocyanine pigments are preferably used. Particularly, a titanylphthalocyanine pigment having titanium as a central metal can make the photosensitive layer more sensitive and prepare a high-speed image forming apparatus. Further, a titanylphthalocyanine crystal having a CuKα 1.542 Å X-ray diffraction spectrum including plural diffraction peaks disclosed in Japanese Laid-Open Patent Publication No. 2001-19871, wherein a maximum diffraction peak is observed at a Bragg (2θ) angle of 27.2°; main peaks are observed at 9.4°, 9.6° and 24.0°; and a minimum diffraction peak is observed at 7.3°; and no diffraction peak is observed at an angle greater than 7.3° and less than 9.4°, wherein said angles may vary by ±0.2° and the minimum interval where no peak is observed between required peaks at 7.3 and 9.4 is 2.0 degrees absolute or more, forms a stable electrophotographic photoreceptor without losing its high sensitivity and deterioration of its chargeability even in repeated use.

Suitable binder resins optionally used in the CGL include polyamides, polyurethanes, epoxy resins, polyketones, polycarbonates, silicone resins, acrylic resins, polyvinyl butyral, polyvinyl formal, polyvinyl ketones, polystyrene, poly-N-vinylcarbazole, polyacrylamide, etc.

These binder resins can be sued alone or in combination.

The CGL typically includes the binder resin in an amount of from 0 to 500 parts by weight, and preferably from 10 to 300 parts by weight per 100 parts by weight of the CGM.

In addition, a charge transport polymer material can be used as a binder resin in the CGL. Further, a charge transport material may be included therein.

The CGL is formed by coating a diluted dispersion, wherein a CGM is dispersed optionally with a binder resin by a ball mil, an attritor or a sand mill, etc. in a solvent such as tetrahydrofuran, cyclohexanone, dioxane, dichloroethane and butanone, on the substrate or optionally on an undercoat layer. The dispersion is coated by a casting method, a dip coating method, a spray coating method or a bead coating method, etc. The casting method is preferably used in the present invention.

The CGL typically has a thickness from 0.01 to 5 μm, and preferably from 0.1 to 2 μm.

Next, the charge transport layer (CTL) 23 will be explained.

The CTL can be formed by dissolving or dispersing a mixture or a copolymer including a charge transport material (CTM) and a binder resin as main components in a proper solvent, coating the dissolved or dispersed liquid on the CGL, and drying the coated liquid.

Specific examples of the polymer binders for use in the CTL include thermoplastic resins or thermosetting resins such as polystyrene, a styrene-acrylonitrile copolymer, a styrene-butadiene copolymer, a styrene-maleic anhydride copolymer, polyester, polyvinylchloride, a vinylchloride-vinylacetate copolymer, polyvinyl acetate, polyvinylidenechloride, polyarylate, a phenoxy resin, polycarbonate, a cellulose acetate resin, an ethyl cellulose resin, a polyvinyl butyral resin, a polyvinyl formal resin, polyvinyl toluene, poly-N-vinyl carbazole, an acrylic resin, a silicone resins, a fluorine-containing resin, an epoxy resin, a melamine resin, a urethane resin, a phenolic resin and an alkyd resin, etc.

These polymer binders can be used alone or in combination, or as a copolymer including two or more of the raw material monomers, or further as a copolymer including the raw material monomer and a charge transport material.

For the purpose of making the CTL resistant to the environmental variation, electrically inactive polymer binders such as polyester, polycarbonate, an acrylic resin, polystyrene, polyvinylchloride, polyvinylidenechloride, polyethylene, polypropylene, a fluorine-containing resin, polyacrylonitrile, an acrylonitrile-styrene-butadiene copolymer, a styrene-acrylonitrile copolymer and an ethylene-vinylacetate copolymer are effectively used.

The electrically inactive polymer is a polymer not including a photoconductive chemical structure, such as a triarylamine structure.

When these resins are used together with the binder resin, the content thereof is preferably not grater than 50% by weight in terms of light attenuation.

In the present invention, the charge transport material having the formula (A) is essentially used. In addition, known electron transport materials (acceptors) and positive-hole transport materials (donors) can be used together.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives, etc. These electron transport materials can be used alone or in combination.

Electron donating materials are preferably used as the positive-hole transport materials.

Specific examples of the positive-hole transport materials include oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, thiophene derivatives, etc. These positive-hole transport materials can be used alone or in combination.

The CTL preferably includes a CTM in an amount of from 40 to 200 parts by weight, and more preferably from 70 to 150 parts by weight per 100 parts by weight of the binder resin. The CTL preferably includes the charge transport material having the formula (A) in an amount of from 50 to 100% by weight based on total weight of the charge transport material.

Specific examples of solvents used for preparing a CTL coating liquid include ketones such as methyl ethyl ketone, acetone, methyl isobutyl ketone and cyclohexanone; ethers such as dioxane, tetrahydrofuran and ethyl cellosolve; aromatic series such as toluene and xylene; halogens such as chlorobenzene and dichloromethane; and esters such as ethylacetate and butyl acetate. These solvents can be sued alone or in combination. In addition, the CTL can optionally include low-molecular-weight compounds such as an antioxidant, a plasticizer, a lubricant, an UV absorber and a leveling agent. These compounds can be used alone or in combination. The CTL preferably includes the low-molecular-weight compounds in an amount of from 0.1 to 50 parts by weight, and more preferably from 0.1 to 20 parts by weight per 100 parts by weight of the resins. The CTL preferably includes the leveling agent in an amount of from 0.001 to 5 parts by weight per 100 parts by weight of the resins.

The CTL coating liquid is coated on the CGL by a dip coating method, a spray coating method, a ring coating method, a roll coating method, a gravure coating method, a nozzle coating method or a screen printing method, etc.

The CTL preferably has a thickness of from 15 to 40 μm, and more preferably from 15 to 30 μm. When image resolution is required, the CTL preferably has a thickness of from 15 to 25 μm.

The undercoat layer 24 may be formed between the substrate and the photosensitive layer. The undercoat layer is formed for the purpose of improving adherence of the photosensitive layer to the substrate, preventing moire, improving coating capability of the above layer, decreasing the residual potential and preventing charge injection from the substrate. The undercoat layer includes a resin as a main constituent. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and hardening resins capable of forming a three-dimensional network such as polyurethane resins, melamine resins, alkyd-melamine resins, epoxy resins, etc.

The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor. The undercoat layer can be formed by using a proper solvent and a conventional coating method.

Further, a metal oxide layer formed by, e.g., a sol-gel method using a silane coupling agent, titanium coupling agent or a chromium coupling agent, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is can be used as the undercoat layer.

The undercoat layer preferably has a thickness of from 0.1 to 10 μm, and more preferably from 1 to 5 μm.

In the present invention, in order to improve the gas barrier properties and environment resistance of a photoreceptor, each layer can include an antioxidant, a plasticizer, an UV absorber, a Low-molecular-weight CTM and a leveling agent.

Further, in the present invention, a photosensitive layer including a CTM having the following formula (B) becomes densified and improves its gas barrier properties, and therefore inhibits deterioration of the resultant photoreceptor due to an oxidizing gas produced by a charger, etc.

(B)

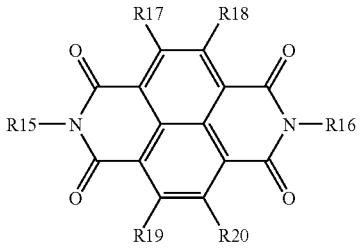

wherein R15 and R16 independently represent a hydrogen atom, and a group selected from the group consisting of substituted or unsubstituted alkyl groups, substituted or unsubstituted cycloalkyl groups and substituted or unsubstituted aralkyl groups; and R17, R18, R19 and R20 independently represent a hydrogen atom, a halogen atom, and a group selected from the group consisting of cyano groups, nitro groups, amino groups, a hydroxyl groups, substituted or unsubstituted alkyl groups, substituted or unsubstituted cycloalkyl groups and substituted or unsubstituted aralkyl groups.

In addition, when the substrate is a flexible sheet such as an aluminum-evaporated PET sheet and a nickel belt, the curl of sheet can be decreased because a layer contraction when formed is reduced, and therefore defects of the resultant photoreceptor, such as a crack, can be inhibited. This is because the CTM having the formula (B) works as a plasticizer. Having charge transportability and being a monomer of the CTM having the formula (A), the CTM having the formula (B) can improve the gas barrier properties and decrease the curl with almost no adverse effect such as a residual potential.

The CTM having the formula (B) is preferably included in a photosensitive layer in an amount of from 1 to 50% by weight based on total weight of the CTM having the formula (A). Since the CTM having the formula (B) has charge transportability less than the CTM having the formula (A), the sensitivity of the resultant photoreceptor occasionally deteriorates when more than 50% by weight.

FIG. 7 is a cross-sectional view of another embodiment of layer structure of the electrophotographic photoreceptor of the present invention, wherein a photosensitive layer 25 including at least a charge generation layer and the CTM having the formula (A) is formed on an electroconductive substrate 21. An undercoat layer can be formed between the electroconductive substrate 21 and the photosensitive layer 25.

The same known charge generation materials used in the CGL of the multilayered photosensitive layer can be used in the single-layered photosensitive layer, and the phthalocyanine pigments are preferably used as well.

Particularly, a titanylphthalocyanine pigment having titanium as a central metal can make the photosensitive layer more sensitive and prepare a high-speed image forming apparatus. Further, similarly to the multilayered photosensitive layer, a titanylphthalocyanine crystal having a CuKα 1.542 Å X-ray diffraction spectrum including plural diffraction peaks disclosed in Japanese Laid-Open Patent Publication No. 2001-19871, wherein a maximum diffraction peak is observed at a Bragg (2θ) angle of 27.2°; main peaks are observed at 9.4°, 9.6° and 24.0°; and a minimum diffraction peak is observed at 7.3°; and no diffraction peak is observed at an angle greater than 7.3° and less than 9.4°, wherein said angles may vary by ±0.2° and the minimum interval where no peak is observed between required peaks at 7.3 and 9.4 is 2.0 degrees absolute or more, forms a stable electrophotographic photoreceptor without losing its high sensitivity and deterioration of its chargeability even in repeated use.

These pigments are preferably dispersed by a ball mill, an attritor or a sand mill, etc. in a solvent such as tetrahydrofuran, cyclohexanone, dioxane, dichloroethane and butanone. In addition, a binder resin may optionally be dispersed therewith.

In the single-layered photosensitive layer, similarly to the multilayered photosensitive layer, the CTM having the formula (A) is essentially used, and in addition, known electron transport materials (acceptors) and positive-hole transport materials (donors) can be used together as well.

The single-layered photosensitive layer preferably includes a CGM in an amount of from 0.1 to 30% by weight, and more preferably from 0.5 to 10% by weight based on total weight of the photosensitive layer. A CTM is preferably included in an amount of from 5 to 300 parts by weight, and more preferably from 10 to 150 parts by weight per 100 parts by weight of a binder resin. However, the CTM having the formula (A) is preferably included in an amount of from 50 to 100% by weight. The positive-hole transport material is preferably included in an amount of from 5 to 300 parts by weight, and more preferably from 20 to 150 parts by weight per 100 parts by weight of a binder resin. When the positive-hole transport material and the electron transport material are combined, they are preferably included in an amount of from 20 to 300 parts by weight, and more preferably from 30 to 200 parts by weight per 100 parts by weight of a binder resin.

Specific examples of solvents used for preparing a photosensitive layer coating liquid include ketones such as methyl ethyl ketone, acetone, methyl isobutyl ketone and cyclohexanone; ethers such as dioxane, tetrahydrofuran and ethyl cellosolve; aromatic series such as toluene and xylene; halogens such as chlorobenzene and dichloromethane; and esters such as ethylacetate and butyl acetate. These solvents can be sued alone or in combination.

In addition, the photosensitive layer can optionally include low-molecular-weight compounds such as an antioxidant, a plasticizer, a lubricant, an UV absorber and a leveling agent. These compounds can be used alone or in combination. The CTL preferably includes the low-molecular-weight compounds in an amount of from 0.1 to 50 parts by weight, and more preferably from 0.1 to 20 parts by weight per 100 parts by weight of the resins. The CTL preferably includes the leveling agent in an amount of from 0.001 to 5 parts by weight per 100 parts by weight of the resins.

Further, even the single-layered photosensitive layer including a CTM having the formula (B) becomes densified and improves its gas barrier properties, and therefore inhibits deterioration of the resultant photoreceptor due to an oxidizing gas produced by a charger, etc. In addition, when the substrate is a flexible sheet such as an aluminum-evaporated PET sheet and a nickel belt, the curl of sheet can be decreased because a layer contraction when formed is reduced, and therefore defects of the resultant photoreceptor, such as a crack, can be inhibited.

The CTM having the formula (B) is preferably included in the single-layered photosensitive layer in an amount of from 1 to 50% by weight based on total weight of the CTM having the formula (A). Since the CTM having the formula (B) has charge transportability less than the CTM having the formula (A), the sensitivity of the resultant photoreceptor occasionally deteriorates when more than 50% by weight.

The photosensitive layer coating liquid is coated on the substrate, optionally on an undercoat layer by a dip coating method, a spray coating method, a ring coating method, a roll coating method, a gravure coating method, a nozzle coating method or a screen printing method, etc.

The photosensitive layer preferably has a thickness of from 10 to 45 μm, and more preferably from 15 to 32 μm. When image resolution is required, the photosensitive layer preferably has a thickness of from 10 to 25 μm.

Next, the CTMs having the formulae (A) and (B) will be explained.

The substituted or unsubstituted alkyl groups has 1 to 25, preferably 1 to 10 carbon atoms. Specific examples thereof include linear alkyl groups such as a methyl group, an ethyl group, a n-propyl group, a n-butyl group, a n-pentyl group, a n-hexyl group, a n-peptyl group, a n-octyl group, a n-nonyl group and a n-decyl group; branched alkyls such as an isopropyl group, a s-butyl group, a t-butyl group, a methylpropyl group, a dimethylpropyl group, an ethylpropyl group, a diethylpropyl group, a methylbutyl group, a dimethylbutyl group, a methylpentyl group, a dimethylpentyl group, a methylhexyl group and a dimethylhexyl group; an alkoxyalkyl group; a monoalkylaminoalkyl group; a dialkylaminoalkyl group; a halogen-substituted alkyl group; an alkylcarbonylalkyl group; a carboxyalkyl group; an alkanoyloxyalkyl group; an aminoalkyl group; an alkyl group substituted with a carboxyl group, which may be esterified; an alkyl group substituted with a cyano group, etc. The substitution sites of these substituents are not particularly limited, and a functional group, wherein a part of carbon atoms of an alkyl group is substituted with a heteroatom such as N, O and S, is included in the substituted alkyl groups.

The substituted or unsubstituted cycloalkyl groups are cycloalkyl rings having 3 to 25, preferably 3 to 10 carbon atoms. Specific examples thereof include congeneric rings such as cyclopropane and cyclodecane; cycloalkyl rings having an alkyl substituent such as methylcyclopentane, dimethylcyclopentane, methylcyclohexne, trimethylcyclohexne, tetramethylcyclohexne, ethylcyclohexne, diethylcyclohexne and t-butylcyclohexne; an alkoxyalkyl group; a monoalkylaminoalkyl group; a dialkylaminoalkyl group; a halogen-substituted alkyl group; an alkylcarbonylalkyl group; a carboxyalkyl group; an alkanoyloxyalkyl group; an aminoalkyl group; a halogen group; an amino group; a carboxyl group which may be esterified; a cycloalkyl group substituted with a cyano group, etc. The substitution sites of these substituents are not particularly limited, and a functional group, wherein a part of carbon atoms of an cycloalkyl group is substituted with a heteroatom such as N, O and S, is included in the substituted cycloalkyl groups.

The substituted or unsubstituted aralkyl groups are substituted or unsubstituted alkyl groups substituted with an aromatic ring, and preferably has 6 to 14 carbon atoms. Specific examples thereof include a benzyl group, a perfluolophenylethyl group, a 1-phenylethyl group, a 2-phenylethyl group, a tert-phenylethyl group, a dimethylphenylethyl group, a diethylphenylethyl group, a t-butylphenylethyl group, a 3-phenylpropyl group, a 4-phenylbutyl group, a 5-phenylpentyl group, a 6-phenylhexy group, a benzhydryl group, a trityl group, etc.

Specific examples of the halogen group include a fluoro group, a chloro group, a bromo group and an iodine group.

Specific examples of methods of preparing the CTM having the formula (A) include the following method:

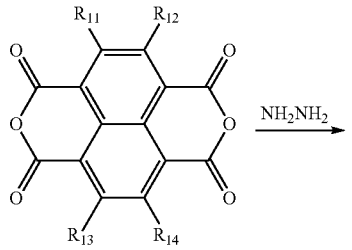

-continued

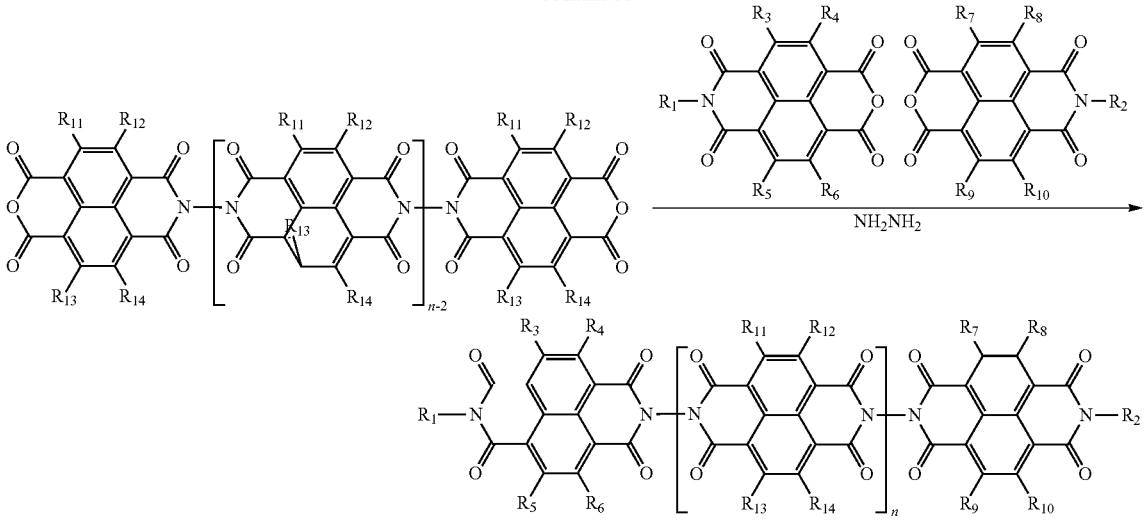

wherein n is a repeat unit and represents 0 and an integer of from 1 to 100.

n is determined by a number-average molecular weight. When n is greater than 100, the solubility in solvents occasionally deteriorates. When n is 1, the CTM is a trimer of naphthalene carboxylic acid. Even oligomers have good charge transportability when substituents of R1 and R2 are properly selected. When n is varied, wide variety of naphthalene carboxylic acid derivatives from oligomers to polymers are synthesized. When oligomers having a low molecular weight is synthesized stepwise, monodispersed compounds can be obtained. Polymers having a high molecular weight is synthesized to compounds having a molecular weight distribution.

Specific examples of the CTM having the formula (A) include CTMs having the following formulae (A-1) to (A-3):

(A-1)

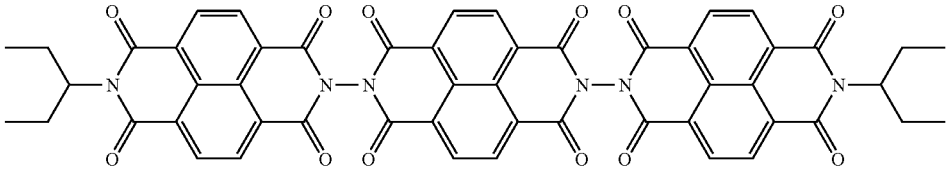

(A-2)

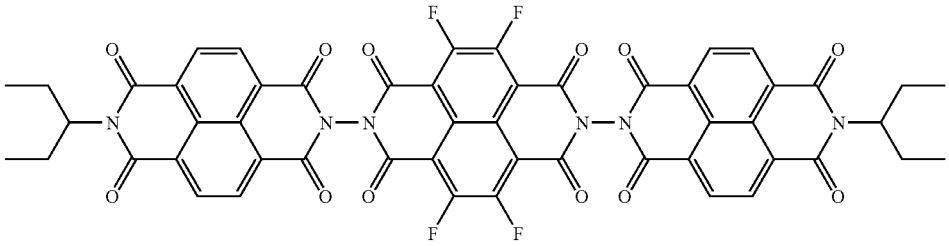

(A-3)

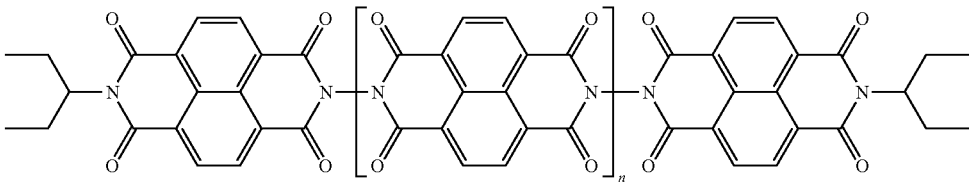

-continued
(A-4)
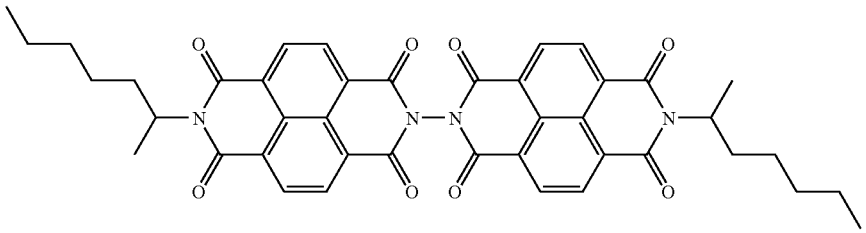
(A-5)
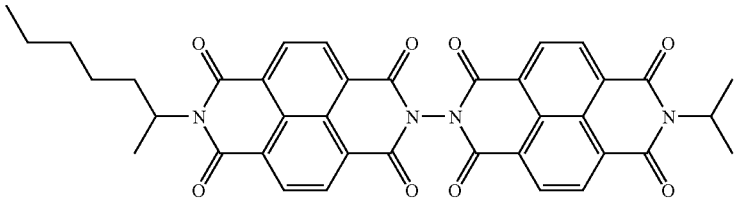
(A-6)
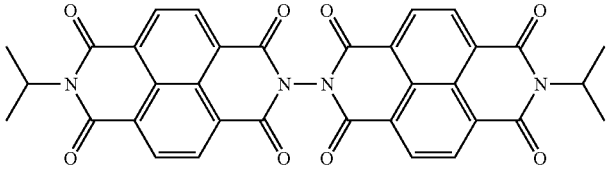
(A-7)
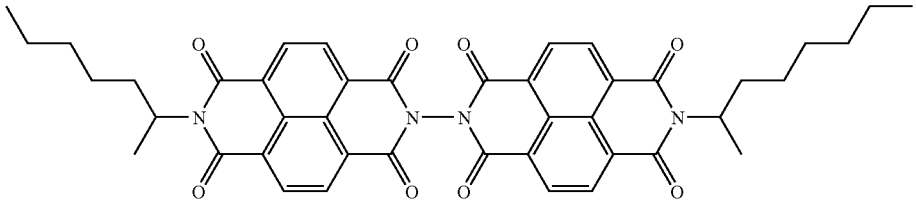
(A-8)
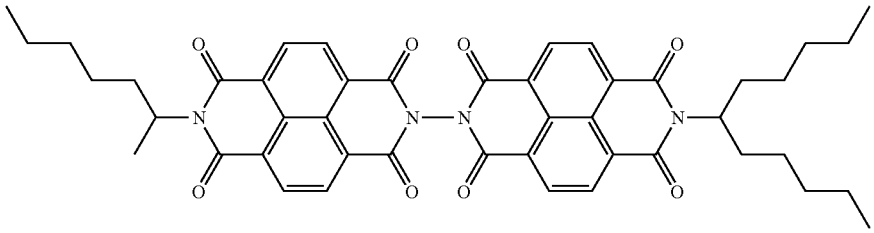
(A-9)
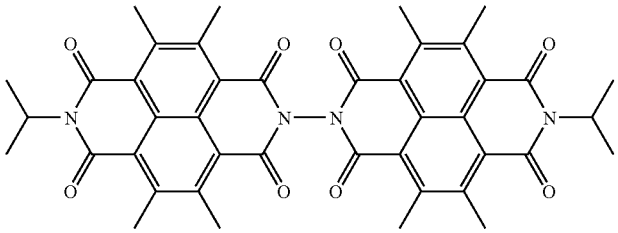
(A-10)
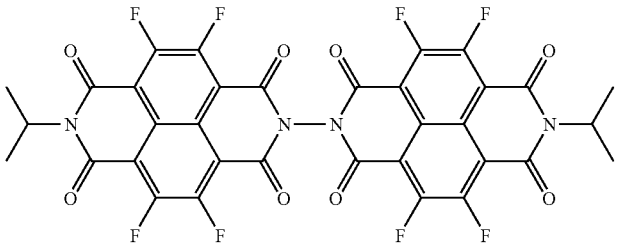

Specific examples of the CTM having the formula (B) include CTMs having the following formulae (B-1) to (B-3):

(B-1)

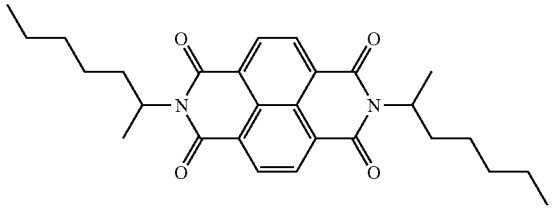

(B-2)

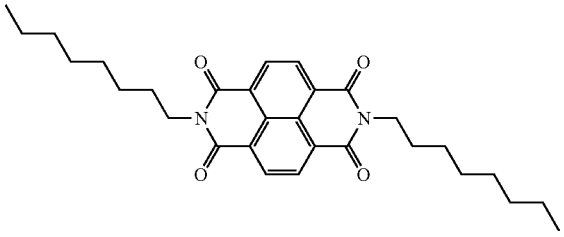

(B-3)

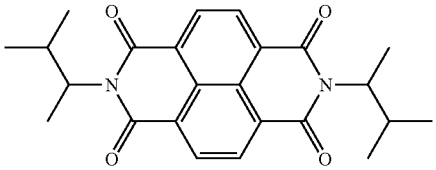

Another embodiment of the invention is the electrophotographic apparatus as above described which includes a plurality of photoreceptors and images developed on the plurality of photoreceptors are transferred and overlaid in order.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

CTM Synthesis Example 1

(First Process)

5.0 g (18.6 mmol) of 1,4,5,8-naphthalenetetracarbocylic acid dianhydride and 50 ml of DMF were heated and refluxed in a four-inlet flask having a capacity of 200 ml. A mixture of 1.10 g (18.6 mmol) of 2-aminoeptane and 25 ml of DMF was dropped in the heated and refluxed materials while stirred. After dropping of the mixture was completed, the materials were further heated and refluxed for 6 hrs. After the reaction is completed, the flask is cooled and the materials therein were depressurized and condensed. Toluene is added to the residue to be refined by silica gel column chromatography. Further, the refined material is recrystallized with a mixed solvent of toluene and hexane to prepare 2.14 g of monoimide A (yield of 31.5%).

(Second Process)

2.0 g (5.47 mmol) of the monoimide A, 0.137 g (2.73 mmol) of hydrazine-hydrate, 10 mg of p-toluenesulfonic acid and 50 ml of toluene were heated and refluxed for 5 hrs in a four-inlet flask having a capacity of 100 ml. After the reaction was completed, the flask was cooled and the materials therein were depressurized and condensed. The residue was refined by silica gel column chromatography. Further, the refined materials were recrystallized with a mixed solvent of toluene and ethylacetate to prepare 0.668 g of a CTM 1 having the formula (A-4) (yield of 33.7%). When mass analyzed (FD-MS), a peak M/z=726 was observed and the CTM was identified as a specified material. The element analysis thereof was carbon of 69.41%, hydrogen of 5.27% and nitrogen of 7.71% in calculated values, and carbon of 69.52%, hydrogen of 5.09% and nitrogen of 7.93% in actual measurement values.

CTM Synthesis Example 2

(First Process)

10 g (37.3 mmol) of 1,4,5,8-naphthalenetetracarbocylic acid dianhydride, 0.931 g (18.6 mmol) of hydrazine-hydrate, 20 mg of p-toluenesulfonic acid and 100 ml of toluene were heated and refluxed for 5 hrs in a four-inlet flask having a capacity of 200 ml. After the reaction was completed, the flask was cooled and the materials therein were depressurized and condensed. The residue was refined by silica gel column chromatography. Further, the refined material is recrystallized with a mixed solvent of toluene and ethylacetate to prepare 2.84 g of a dimer C (yield of 28.7%).

(Second Process)

2.5 g (4.67 mmol) of the dimer C and 30 ml of DMF were heated and refluxed in a four-inlet flask having a capacity of 100 ml. A mixture of 0.278 g (4.67 mmol) of 2-aminopropane and 10 ml of DMF was dropped in the heated and refluxed material while stirred. After dropping of the mixture was completed, the heated and refluxed material was further heated and refluxed for 6 hrs. After the reaction was completed, the flask was cooled and the material therein was depressurized and condensed. Toluene was added to the residue to be refined by silica gel column chromatography to prepare 0.556 g of monoimide C (yield of 38.5%).

(Third Process)

0.50 g (1.62 mmol) of the of monoimide C and 10 ml of DMF were heated and refluxed in a four-inlet flask having a capacity of 50 ml. A mixture of 0.186 g (1.62 mmol) of 2-aminoheptane and 5 ml of DMF was dropped in the heated and refluxed material while stirred. After dropping of the mixture was completed, the heated and refluxed material was further heated and refluxed for 6 hrs. After the reaction was completed, the flask was cooled and the material therein was depressurized and condensed. Toluene was added to the residue to be refined by silica gel column chromatography. Further, the refined materials were recrystallized with a mixed solvent of toluene and hexane to prepare 0.243 g of a CTM 2 having the formula (A-5) (yield of 22.4%). When mass analyzed (FD-MS), a peak M/z=670 was observed and the CTM was identified as a specified material. The element analysis thereof was carbon of 68.051%, hydrogen of 4.51% and nitrogen of 8.35% in calculated values, and carbon of 68.29%, hydrogen of 4.72% and nitrogen of 8.33% in actual measurement values.

CTM Synthesis Example 3

(First Process)

5.0 g (9.39 mmol) of the dimer C and 50 ml of DMF were heated and refluxed in a four-inlet flask having a capacity of 200 ml. A mixture of 1.08 g (9.39 mmol) of 2-aminoheptane and 25 ml of DMF was dropped in the heated and refluxed material while stirred. After dropping of the mixture was completed, the heated and refluxed material was further heated and refluxed for 6 hrs. After the reaction was completed, the flask was cooled and the material therein was depressurized and condensed. Toluene was added to the residue to be refined by silica gel column chromatography to prepare 1.66 g of monoimide D (yield of 28.1%).

(Second Process)

1.5 g (2.38 mmol) of the of monoimide D and 50 ml of DMF were heated and refluxed in a four-inlet flask having a capacity of 100 ml. A mixture of 0.308 g (2.38 mmol) of 2-aminooctane and 10 ml of DMF was dropped in the heated and refluxed material while stirred. After dropping of the mixture was completed, the heated and refluxed material was further heated and refluxed for 6 hrs. After the reaction was completed, the flask was cooled and the material therein was depressurized and condensed. Toluene was added to the residue to be refined by silica gel column chromatography. Further, the refined materials were recrystallized with a mixed solvent of toluene and hexane to prepare 0.328 g of a CTM 3 having the formula (A-7) (yield of 18.6%). When mass analyzed (FD-MS), a peak M/z=740 was observed and the CTM was identified as a specified material. The element analysis thereof was carbon of 69.72%, hydrogen of 5.44% and nitrogen of 7.56% in calculated values, and carbon of 69.55%, hydrogen of 5.26% and nitrogen of 7.33% in actual measurement values.

CTM Synthesis Example 4

(First Process)

5.0 g (18.6 mmol) of 1,4,5,8-naphthalenetetracarbocylic acid dianhydride and 50 ml of DMF were heated and refluxed in a four-inlet flask having a capacity of 200 ml. A mixture of 1.62 g (18.6 mmol) of 2-aminopentane and 25 ml of DMF was dropped in the heated and refluxed materials while stirred. After dropping of the mixture was completed, the materials were further heated and refluxed for 6 hrs. After the reaction is completed, the flask is cooled and the materials therein were depressurized and condensed. Toluene is added to the residue to be refined by silica gel column chromatography. Further, the refined material is recrystallized with a mixed solvent of toluene and hexane to prepare 3.49 g of monoimide E (yield of 45.8%).

(Second Process)

2.0 g (5.47 mmol) of the monoimide E, 0.137 g (2.73 mmol) of hydrazine-hydrate, 10 mg of p-toluenesulfonic acid and 50 ml of toluene were heated and refluxed for 5 hrs in a four-inlet flask having a capacity of 100 ml. After the reaction was completed, the flask was cooled and the materials therein were depressurized and condensed. The residue was refined by silica gel column chromatography. Further, the refined materials were recrystallized with a mixed solvent of toluene and ethylacetate to prepare 0.668 g of a CTM 4 having the formula (A-1) (yield of 33.7%). When mass analyzed (FD-MS), a peak M/z=934 was observed and the CTM was identified as a specified material. The element analysis thereof was carbon of 66.81%, hydrogen of 3.67% and nitrogen of 8.99% in calculated values, and carbon of 66.92%, hydrogen of 3.74% and nitrogen of 9.05% in actual measurement values.

Pigment Synthesis Example 1

A pigment was prepared in accordance with a method disclosed in the production Example in Japanese Laid-Open Patent Publication No. 2-8256 (Japanese Patent Publication No. 7-91486). Namely, 9.8 g of phthalodinitrile and 75 ml of 1-chloronaphthalene were mixed and stirred, and a 2.2 ml of titanium tetrachloride was dropped in the mixture under a nitrogen gas stream. The mixture was gradually heated to have a temperature of 200° C. and stirred for 3 hrs while the reaction temperature was maintained at 200 to 220° C. Then, the mixture was cooled to have a temperature of 130° C. and filtered to prepare a powder. After the powder was washed to have a blue color with 1-chloronaphthalene, methanol for several times and hot water having a temperature of 80° C. for several times, the powder was dried to prepare a titanylphthalocyanine powder (Pigment 1).

The X-ray diffraction spectrum of the Pigment 1 was measured by the following conditions to find that the spectrum is same as disclosed in the Publication.

X-ray tube: Cu
Voltage: 40 kV
Current: 20 mA
Scanning speed: 1°/min
Scanning range: 3 to 40°
Time constant: 2 sec Pigment Synthesis Example 2

A pigment was prepared by the method disclosed in Synthesis Example 1 of Japanese Laid-Open Patent Publications Nos. 2001-19871. Namely, 29.2 g of 1,3-diiminoisoindoline and 200 ml of sulfolane were mixed, and 20.4 g of titaniumtetrabutoxide were dropped into the mixture under a nitrogen gas stream. The mixture was gradually heated until the mixture had a temperature of 180° C. and stirred for 5 hrs while the reaction temperature was maintained from 170 to 180° C. After the mixture was cooled, a precipitated material (powder) was filtered and washed with chloroform until the powder became blue. Next, the powder was washed with methanol for several times, and further washed with hot water having a temperature of 80° C. for several times to prepare a crude titanylphthalocyanine pigment. The crude titanylphthalocyanine pigment was mixed in a concentrated sulfonic acid in an amount of 20 times as much as the crude titanylphthalocyanine pigment and stirred therein to dissolve the pigment therein, and the mixture was dropped in iced water in an amount of 100 times as much as the mixture while stirred, and a precipitated crystal was filtered. Then, the crystal was repeatedly washed with water until the water became neutral to prepare a wet cake (water paste) of a titanylphthalocyanine pigment. 2 g of the wet cake was placed in 20 g of tetrahydrofuran, and after the mixture was stirred for 4 hrs, the mixture was filtered and dried to prepare a titanylphthalocyanine powder (Pigment 2).

When the X-ray diffraction spectrum of the Pigment 2 was measured by the same conditions of Pigment 1, it was confirmed that the titanylphthalocyanine powder has an X-ray diffraction spectrum such that a maximum peak is observed at a Bragg (2θ) angle of 27.2±0.2°, a lowest angle peak at an angle of 7.3±0.2°, and a main peak at each of angles of 9.4±0.2°, 9.6±0.2°, and 24.0±0.2°, wherein no peak is observed between the peaks of 7.3° and 9.4° as disclosed in the Publication.

Photoreceptor Preparation Example 1

An undercoat layer coating liquid, a CGL coating liquid and a CTL coating liquid having the following formulae respectively were prepared.

Undercoat Layer Coating Liquid

The following materials were dispersed for 5 days with a ball mill using alumina balls having a diameter of 10 mm to prepare an undercoat layer coating liquid.

| | |
|---|---|
| Alkyd resin (Bekkosol M-6401-50 from Dainippon Ink And Chemicals, inc.) | 60 |
| Melamine resin (SUPER BEKKAMIN L-121-60 from Dainippon Ink And Chemicals, inc.) | 40 |
| Titanium oxide (CR-EL from Ishihara Sangyo Kaisha, ltd.) | 400 |
| Methyl ethyl ketone | 500 |

CGL Coating Liquid

The following materials were dispersed for 5 hrs in a glass pot having a diameter of 9 cm at 100 rpm using PSZ balls having a diameter of 0.5 mm to prepare a CGL coating liquid.

| | |
|---|---|
| Metal-free phthalocyanine pigment (FASTOGEN Blue 8120B from Dainippon Ink And Chemicals, inc.) | 12 |
| Polyvinylbutyral resin (Eslec BX-1 from Sekisui Chemical Co., Ltd.) | 5 |
| 2-butanone | 200 |
| Cyclohexanone | 400 |

CTL Coating Liquid

The following materials were stirred and dissolved to prepare a CTL coating liquid.

| | |
|---|---|
| CTM 1 | 10 |
| Z-type polycarbonate resin (PANLITE TS-2050 from Teijin Chemicals Ltd.) | 10 |
| Silicone oil (KF50 from Shin-Etsu Chemical Co., Ltd.) | 0.01 |
| Tetrahydrofuran | 80 |

Next, the undercoat layer coating liquid, CGL coating liquid and CTL coating liquid were coated on an aluminum drum having a diameter of 30 mm and a length of 340 mm in this order by a dip coating method to form an undercoat layer 4.5 μm thick, a CGL 0.15 μm and a CTL 25 μm thick thereon.

The layers were dried at 135° C. for 20 min, 80° C. for 15 min and 120° C. for 20 min respectively.

Thus, a photoreceptor 1 was prepared.

Photoreceptor Preparation Example 2

The following materials were dispersed for 5 hrs in a glass pot having a diameter of 9 cm at 100 rpm using PSZ balls having a diameter of 0.5 mm to prepare a pigment dispersion.

| | |
|---|---|
| Metal-free phthalocyanine pigment (FASTOGEN Blue 8120B from Dainippon Ink And Chemicals, inc.) | 3 |
| Cyclohexanone | 97 |

The following materials including the pigment dispersion were stirred and dissolved to prepare a photosensitive layer coating liquid.

| | |
|---|---|
| Pigment dispersion | 60 |
| Positive-hole CTM having the following formula: | 25 |

-continued

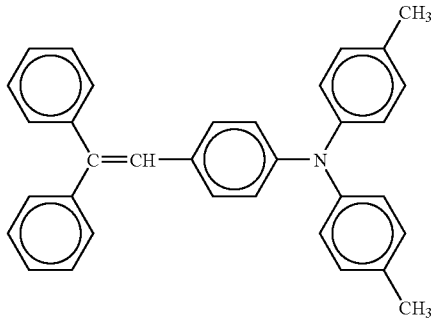

| | |
|---|---|
| CTM 1 | 25 |
| Z-type polycarbonate resin (PANLITE TS-2050 from Teijin Chemicals Ltd.) | 50 |
| Silicone oil (KF50 from Shin-Etsu ChemicalCo., Ltd.) | 0.01 |
| Tetrahydrofuran | 350 |

The photosensitive layer coating liquid was coated on an aluminum drum having a diameter of 30 mm and a length of 340 mm by a dip coating method to form a photosensitive layer 25 μm thick thereon, and the layer was dried 120° C. for 20 min to prepare a photoreceptor 2.

Photoreceptor Preparation Example 3

The procedure for preparation of the photoreceptor 1 in Photoreceptor Preparation Example 1 was repeated to prepare a photoreceptor 3 except for using the Pigment 1 as a CGM in place of the metal-free phthalocyanine pigment (FASTOGEN Blue 8120B).

Photoreceptor Preparation Example 4

The procedure for preparation of the photoreceptor 2 in Photoreceptor Preparation Example 2 was repeated to prepare a photoreceptor 4 except for using the Pigment 1 as a CGM in place of the metal-free phthalocyanine pigment (FASTOGEN Blue 8120B).

Photoreceptor Preparation Example 5

The procedure for preparation of the photoreceptor 1 in Photoreceptor Preparation Example 1 was repeated to prepare a photoreceptor 5 except for using the Pigment 2 as a CGM in place of the metal-free phthalocyanine pigment (FASTOGEN Blue 8120B).

Photoreceptor Preparation Example 6

The procedure for preparation of the photoreceptor 2 in Photoreceptor Preparation Example 2 was repeated to prepare a photoreceptor 6 except for using the Pigment 2 as a CGM in place of the metal-free phthalocyanine pigment (FASTOGEN Blue 8120B).

Photoreceptor Preparation Example 7

The procedure for preparation of the photoreceptor 5 in Photoreceptor Preparation Example 5 was repeated to prepare a photoreceptor 7 except for using the CTM 2 in place of the CTM 1.

Photoreceptor Preparation Example 8

The procedure for preparation of the photoreceptor 6 in Photoreceptor Preparation Example 6 was repeated to prepare a photoreceptor 8 except for using the CTM 2 in place of the CTM 1.

Photoreceptor Preparation Example 9

The procedure for preparation of the photoreceptor 5 in Photoreceptor Preparation Example 5 was repeated to prepare a photoreceptor 9 except for using the CTM 3 in place of the CTM 1.

Photoreceptor Preparation Example 10

The procedure for preparation of the photoreceptor 6 in Photoreceptor Preparation Example 6 was repeated to prepare a photoreceptor 10 except for using the CTM 3 in place of the CTM 1.

Photoreceptor Preparation Example 11

The procedure for preparation of the photoreceptor 5 in Photoreceptor Preparation Example 5 was repeated to prepare a photoreceptor 11 except for using a compound having the following formula (C) in place of the CTM 1.

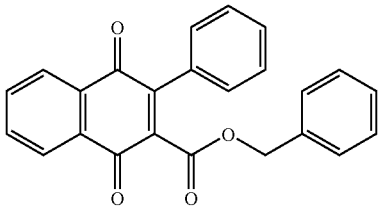

Photoreceptor Preparation Example 12

The procedure for preparation of the photoreceptor 6 in Photoreceptor Preparation Example 6 was repeated to prepare a photoreceptor 12 except for using the compound having the formula (C) in place of the CTM 1.

Photoreceptor Preparation Example 13

The procedure for preparation of the photoreceptor 5 in Photoreceptor Preparation Example 5 was repeated to prepare a photoreceptor 13 except for using a compound having the following formula (D) in place of the CTM 1.

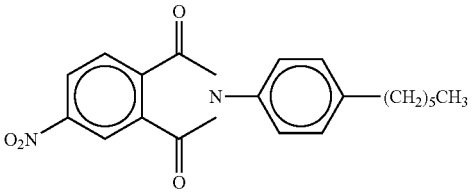

Photoreceptor Preparation Example 14

The procedure for preparation of the photoreceptor 6 in Photoreceptor Preparation Example 6 was repeated to prepare a photoreceptor 14 except for using the compound having the formula (D) in place of the CTM 1.

Photoreceptor Preparation Example 15

The procedure for preparation of the photoreceptor 5 in Photoreceptor Preparation Example 5 was repeated to prepare a photoreceptor 15 except for using the CTM 4 in place of the CTM 1.

Photoreceptor Preparation Example 16

The procedure for preparation of the photoreceptor 6 in Photoreceptor Preparation Example 6 was repeated to prepare a photoreceptor 16 except for using the CTM 4 in place of the CTM 1.

Photoreceptor Preparation Example 17

The procedure for preparation of the photoreceptor 5 in Photoreceptor Preparation Example 5 was repeated to prepare a photoreceptor 17 except for replacing 10 parts of the CTM 1 with 8 parts thereof and 2 parts of the CTM having the formula (B-1).

Photoreceptor Preparation Example 18

The procedure for preparation of the photoreceptor 6 in Photoreceptor Preparation Example 6 was repeated to prepare a photoreceptor 18 except for replacing 10 parts of the CTM 1 with 8 parts thereof and 2 parts of the CTM having the formula (B-1).

Examples 1 to 14 and Comparative Example 1 to 4

Each of the photoreceptors 1 to 18 was installed in a modified image forming apparatus imagio neo 270 from Ricoh Company, Ltd., wherein the power pack was changed to be positively charged and the light source of the irradiator was changed to a LED, and a running test wherein 10,000 images of A4 chart having an average image area of 5% were continuously produced was performed at 23° C. and 55% RH.

The LEDs having a wavelength of 780 nm were located on a glass substrate in the shape of an array to form a focusing lens array such that the LEDs write on the surface of a photoreceptor.

The exclusive toner or developer for imagio neo 270 were changed to a toner or a developer having a reverse polarity.

The charger used an external electrical source, and the charging roller had a voltage of 1.9 kV between peaks and a frequency of 1.35 kHz as an AC component. The DC component was a bias such that the charged potential of the photoreceptor when the running test began was +600 V. The charging conditions remained unchanged until the running test was completed. The developing bias was +450 V.

The image quality and resolution were evaluated after the running test was completed.

(Image Quality)

An image for evaluation was produced to visually evaluate the background fouling, foggy images and image density thereof. (Image resolution)

A halftone image was produced to observe status of the dot formation such as dot scattering and dot reproducibility.

Either of the image quality and image resolution was graded as follows:

◎: Very good

○: Good

Δ: Slightly poor

×: Very poor

The evaluation results are shown in Table 1.

TABLE 1

| | Photoreceptor | Image quality | Image resolution |
|---|---|---|---|
| Example 1 | 1 | ◎ | ○ |
| Example 2 | 2 | ◎ | ○ |
| Example 3 | 3 | ○ | ○ |
| Example 4 | 4 | ○ | ○ |
| Example 5 | 5 | ◎ | ◎ |
| Example 6 | 6 | ◎ | ◎ |
| Example 7 | 7 | ◎ | ◎ |
| Example 8 | 8 | ◎ | ◎ |
| Example 9 | 9 | ◎ | ◎ |
| Example 10 | 10 | ◎ | ◎ |
| Example 11 | 15 | ◎ | ◎ |
| Example 12 | 16 | ◎ | ◎ |
| Example 13 | 17 | ◎ | ◎ |
| Example 14 | 18 | ◎ | ◎ |
| Comparative Example 1 | 11 | X | X |
| Comparative Example 2 | 12 | Δ | Δ |
| Comparative Example 3 | 13 | X | X |
| Comparative Example 4 | 14 | X | X |

Examples 15 to 21

Each of the photoreceptors 2, 4, 6, 8, 10, 16 and 18 was installed in a modified image forming apparatus imagio neo 270 using a contact charging roller from Ricoh Company, Ltd., wherein the light source of the irradiator was changed to a LED, and a running test wherein 10,000 images of A4 chart having an average image area of 5% were continuously produced was performed at 23° C. and 55% RH.

The LEDs having a wavelength of 780 nm were located on a glass substrate in the shape of an array to form a focusing lens array such that the LEDs write on the surface of a photoreceptor.

The charger used an external electrical source, and the charging roller had a voltage of 1.9 kV between peaks and a frequency of 1.35 kHz as an AC component. The DC component was a bias such that the charged potential of the photoreceptor when the running test began was +600 V. The charging conditions remained unchanged until the running test was completed. The developing bias was +450 V.

The image quality and resolution were evaluated after the running test was completed.

(Image Quality)

An image for evaluation was produced to visually evaluate the background fouling, foggy images and image density thereof.

(Image Resolution)

A halftone image was produced to observe status of the dot formation such as dot scattering and dot reproducibility.

Either of the image quality and image resolution was graded as follows:

◎: Very good

○: Good

Δ: Slightly poor

×: Very poor

The evaluation results are shown in Table 2.

TABLE 2

| | Photoreceptor | Image quality | Image resolution |
|---|---|---|---|
| Example 15 | 2 | ◎ | ○ |
| Example 16 | 4 | ○ | ○ |
| Example 17 | 6 | ◎ | ◎ |
| Example 18 | 8 | ◎ | ◎ |
| Example 19 | 10 | ◎ | ○ |
| Example 20 | 16 | ◎ | ◎ |
| Example 21 | 18 | ◎ | ○ |

Examples 22 to 35 and Comparative Examples 5 to 8

Each of the photoreceptors 1 to 18 was installed in a modified tandem image forming apparatus IPSiO Color 8100 from Ricoh Company, Ltd., wherein the power pack was changed to be positively charged and the light source of the irradiator was changed to a LED, and a running test wherein 10,000 images of A4 chart having an average image area of 5% were continuously produced was performed at 23° C. and 55% RH.

The LEDs having a wavelength of 780 nm were located on a glass substrate in the shape of an array to form a focusing lens array such that the LEDs write on the surface of a photoreceptor.

The exclusive toner or developer for IPSiO Color 8100 were changed to a toner or a developer having a reverse polarity.

The charger used an external electrical source, and the charging roller had a voltage of 1.9 kV between peaks and a frequency of 1.35 kHz as an AC component. The DC component was a bias such that the charged potential of the photoreceptor when the running test began was +600 V. The charging conditions remained unchanged until the running test was completed. The developing bias was +450 V.

The image quality and color reproducibility were evaluated after the running test was completed.

(Image Quality)

An image for evaluation was produced to visually evaluate the background fouling, foggy images and image density thereof.

(Color Reproducibility)

An ISO/JIS-SCID image N1 (portrait) was produced to evaluated the color reproducibility.

Either of the image quality and color reproducibility was graded as follows:

◎: Very good

○: Good

Δ: Slightly poor

×: Very poor

The evaluation results are shown in Table 3.

TABLE 3

| | Photoreceptor | Image quality | Image resolution |
|---|---|---|---|
| Example 22 | 1 | ◎ | ◎ |
| Example 23 | 2 | ◎ | ◎ |
| Example 24 | 3 | ○ | ○ |
| Example 25 | 4 | ○ | ○ |
| Example 26 | 5 | ◎ | ◎ |
| Example 27 | 6 | ◎ | ◎ |
| Example 28 | 7 | ◎ | ◎ |
| Example 29 | 8 | ◎ | ◎ |
| Example 30 | 9 | ◎ | ◎ |
| Example 31 | 10 | ◎ | ◎ |
| Example 32 | 15 | ◎ | ◎ |
| Example 33 | 16 | ◎ | ◎ |

TABLE 3-continued

| | Photoreceptor | Image quality | Image resolution |
|---|---|---|---|
| Example 34 | 17 | ◎ | ○ |
| Example 35 | 18 | ◎ | ◎ |
| Comparative Example 5 | 11 | X | X |
| Comparative Example 6 | 12 | Δ | X |
| Comparative Example 7 | 13 | X | X |
| Comparative Example 8 | 14 | X | X |

Examples 36 to 39

The photoreceptors 5, 6, 17 and 18 were left in an environment having an ozone concentration of 10 ppm for 5 days.

The image quality and resolution were evaluated after the ozone exposition test was completed, using the image forming apparatus used in Examples 1 to 14 and Comparative Examples 1 to 4.

(Image Quality)

An image for evaluation was produced to visually evaluate the background fouling, foggy images and image density thereof.

(Image Resolution)

A halftone image was produced to observe status of the dot formation such as dot scattering and dot reproducibility.

Either of the image quality and image resolution was graded as follows:

◎: Very good

○: Good

Δ: Slightly poor

×: Very poor

The evaluation results are shown in Table 4.

TABLE 4

| | Photoreceptor | Image quality | Image resolution |
|---|---|---|---|
| Example 36 | 5 | ○ | ○ |
| Example 37 | 6 | ○ | Δ |
| Example 38 | 17 | ◎ | ◎ |
| Example 39 | 18 | ◎ | ○ |

Examples 40 to 51

Each of the photoreceptors 1 to 12 was installed in a modified image forming apparatus imagio neo 270 from Ricoh Company, Ltd., wherein the powerpack was changed to be positively charged and the charger was changed to a non-contact charging roller as shown in FIG. 2, and a running test wherein 10,000 images of A4 chart having an average image area of 5% were continuously produced was performed at 23° C. and 55% RH.

A gap between the photoreceptor and the charging was 50 μm.

The exclusive toner or developer for imagio neo 270 were changed to a toner or a developer having a reverse polarity.

The charger used an external electrical source, and the charging roller had a voltage of 1.9 kV between peaks and a frequency of 1.35 kHz as an AC component. The DC component was a bias such that the charged potential of the photoreceptor when the running test began was $_{+}$600 V. The charging conditions remained unchanged until the running test was completed. The developing bias was +450 V.

The image quality, and the potentials on the surface of the photoreceptor when moved to the developing site before (PB) and after (PA) irradiated were evaluated, before and after the running test.

(Image Quality)

An image for evaluation was produced to visually evaluate the background fouling, foggy images and image density thereof.

The evaluation results are shown in Table 5

TABLE 5

| | | PA (V) | | PB (V) | | Image quality | |
|---|---|---|---|---|---|---|---|
| | Photoreceptor | Initial | After 10,000 | Initial | After 10,000 | Initial | After 10,000 |
| Example 40 | 1 | 600 | 590 | 80 | 90 | ○ to ◎ | |
| Example 41 | 2 | 600 | 590 | 70 | 90 | ○ to ◎ | |
| Example 42 | 3 | 600 | 580 | 80 | 110 | ○ to ◎ | ○ to ◎ |
| Example 43 | 4 | 600 | 580 | 80 | 100 | ○ to ◎ | ○ to ◎ |
| Example 44 | 5 | 600 | 590 | 60 | 70 | ◎ | ◎ |
| Example 45 | 6 | 600 | 590 | 50 | 50 | ◎ | ◎ |
| Example 46 | 7 | 600 | 550 | 90 | 100 | ○ to ◎ | ○ to ◎ |
| Example 47 | 8 | 600 | 540 | 90 | 100 | ○ to ◎ | ○ to ◎ |
| Example 48 | 9 | 600 | 580 | 90 | 110 | ○ to ◎ | ○ to ◎ |
| Example 49 | 10 | 600 | 570 | 80 | 110 | ○ to ◎ | ○ to ◎ |
| Example 50 | 11 | 600 | 580 | 90 | 110 | ○ to ◎ | ○ to ◎ |
| Example 51 | 12 | 600 | 580 | 90 | 100 | ○ to ◎ | ○ to ◎ |

Examples 52 to 65

Each of the photoreceptors 1 to 10 and 15 to 18 was installed in a modified tandem image forming apparatus IPSiO CX400 using an intermediate transferer from Ricoh Company, Ltd., wherein the power pack was changed to be positively charged and the light source of the irradiator was changed to a LD having a wavelength of 780 nm, and a running test wherein 10, 000 images of A4 chart having an average image area of 5% were continuously produced was performed at 23° C. and 55% RH.

The exclusive toner or developer for IPSiO CX400 were changed to a toner or a developer having a reverse polarity.

The image quality and resolution were evaluated before and the running test.

(Image Quality)

An image for evaluation was produced to visually evaluate the background fouling, foggy images and image density thereof.

(Image Resolution)

A halftone image was produced to observe status of the dot formation such as dot scattering and dot reproducibility.

Either of the image quality and image resolution was graded as follows:

◎: Very good

○: Good

Δ: Slightly poor

×: Very poor

The evaluation results are shown in Table 6.

TABLE 6

| | | Image quality | | Image resolution | |
|---|---|---|---|---|---|
| | Photoreceptor | Initial | After 10,000 | Initial | After 10,000 |
| Example 52 | 1 | ◎ | ○ | ○ | ○ |
| Example 53 | 2 | ◎ | ○ | ○ | ○ |
| Example 54 | 3 | ◎ | ○ | ◎ | ○ |
| Example 55 | 4 | ◎ | ○ | ◎ | ○ |
| Example 56 | 5 | ◎ | ◎ | ◎ | ○ |
| Example 57 | 6 | ◎ | ◎ | ◎ | ◎ |
| Example 58 | 7 | ◎ | ◎ | ◎ | ○ |

TABLE 6-continued

| | | Image quality | | Image resolution | |
|---|---|---|---|---|---|
| | Photoreceptor | Initial | After 10,000 | Initial | After 10,000 |
| Example 59 | 8 | ◎ | ◎ | ◎ | ◎ |
| Example 60 | 9 | ◎ | ○ | ◎ | ○ |
| Example 61 | 10 | ◎ | ◎ | ◎ | ◎ |
| Example 62 | 15 | ◎ | ◎ | ◎ | ○ |
| Example 63 | 16 | ◎ | ◎ | ◎ | ◎ |
| Example 64 | 17 | ◎ | ◎ | ◎ | ○ |
| Example 65 | 18 | ◎ | ◎ | ◎ | ◎ |

Examples 66 to 79

Each of the photoreceptors 1 to 10 and 15 to 18 was installed in a modified image forming apparatus imagio neo 270 from Ricoh Company, Ltd., wherein the power pack was changed to be positively charged and an additive applicator applying zinc stearate as shown in FIG. 4 was installed, and a running test wherein 50,000 images of A4 chart having an average image area of 5% were continuously produced was performed at 23° C. and 55% RH.

The exclusive toner or developer for imagio neo 270 were changed to a toner or a developer having a reverse polarity.

The charger used an external electrical source, and the charging roller had a voltage of 1.9 kV between peaks and a frequency of 1.35 kHz as an AC component. The DC component was a bias such that the charged potential of the photoreceptor when the running test began was +600 V. The charging conditions remained unchanged until the running test was completed. The developing bias was +450 V.

The image quality, and the potentials on the surface of the photoreceptor when moved to the developing site before (PB) and after (PA) irradiated were evaluated, before and after the running test.

(Image Quality)

An image for evaluation was produced to visually evaluate the background fouling, foggy images and image density thereof.

The evaluation results are shown in Table 7.

TABLE 7

| | | | PA (V) | | PB (V) | | Image quality | |
|---|---|---|---|---|---|---|---|---|
| | Photoreceptor | Additive | Initial | After 10,000 | Initial | After 10,000 | Initial | After 10,000 |
| Example 66 | 1 | used | 600 | 590 | 80 | 100 | ◎ | ◎ |
| Example 67 | 2 | used | 600 | 580 | 70 | 90 | ◎ | ◎ |
| Example 68 | 3 | used | 600 | 550 | 90 | 110 | ◎ | ○ |
| Example 69 | 4 | used | 600 | 540 | 90 | 100 | ◎ | ○ |
| Example 70 | 5 | used | 600 | 580 | 80 | 110 | ◎ | ◎ |
| Example 71 | 6 | used | 600 | 570 | 80 | 110 | ◎ | ◎ |
| Example 72 | 7 | used | 600 | 580 | 90 | 120 | ◎ | ◎ |
| Example 73 | 8 | used | 600 | 570 | 80 | 110 | ◎ | ◎ |
| Example 74 | 9 | used | 600 | 580 | 90 | 120 | ◎ | ○ |
| Example 75 | 10 | used | 600 | 580 | 90 | 100 | ◎ | ◎ |
| Example 76 | 15 | used | 600 | 590 | 90 | 120 | ◎ | ◎ |
| Example 77 | 16 | used | 600 | 590 | 90 | 110 | ◎ | ◎ |
| Example 78 | 17 | used | 600 | 580 | 100 | 110 | ◎ | ◎ |
| Example 79 | 18 | used | 600 | 570 | 90 | 90 | ◎ | ◎ |

Tables 1 to 7 show that image forming apparatuses using photoreceptors satisfying the requirements of the present invention produce high-resolution images without abnormal images even when repeatedly used.

This application claims priority and contains subject matter related to Japanese Patent Applications Nos. 2005-271016, 2005-264722, 2005-266245, 2005-269167, 2005-267953, 2005-271006 and 2005-267955, filed on Sep. 16, 2005, Sep. 13, 2005, Sep. 14, 2005, Sep. 15, 2005, Sep. 15, 2005, Sep. 16, 2005 and Sep. 15, 2005 respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A process cartridge, comprising:

a photoreceptor; and at least one member selected from the group consisting of a charger, an imagewise light irradiator, an image developer, and a cleaner, wherein the photoreceptor comprises an electroconductive substrate and a photosensitive layer located overlying the electroconductive substrate, comprising a charge generation material and a charge transport material, wherein the charge transport material has the following formula (1):

(1)

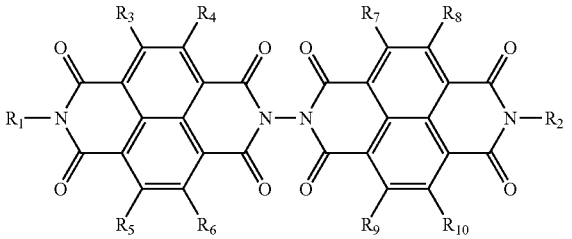

wherein R1 and R2 independently represent a hydrogen atom, or a group selected from the group consisting of substituted and unsubstituted alkyl groups, substituted and unsubstituted cycloalkyl groups, and substituted and unsubstituted aralkyl groups; and R3, R4, R5, R6, R7, R8, R9, and R10 independently represent a hydrogen atom, a halogen atom, or a group selected from the group consisting of cyano groups, nitro groups, amino groups, hydroxyl groups, substituted and unsubstituted alkyl groups, substituted and unsubstituted cycloalkyl groups, and substituted and unsubstituted aralkyl groups.

2. The process cartridge according to claim 1, wherein the charge generation material is phthalocyanine.

3. The process cartridge according to claim 1, wherein the charger is a non-contact charger located such that a gap between the charger and the photoreceptor is not longer than 200 μm.

4. The process cartridge according to claim 1, wherein the cleaner comprises a cleaning blade.

5. An electrophotographic image forming apparatus, comprising:

a photoreceptor, a charger configured to charge the surface of the photoreceptor, an irradiator configured to irradiate the surface of the photoreceptor with imagewise light to form an electrostatic latent image thereon, an image developer configured to develop the electrostatic latent image with a developer comprising a toner to form a toner image on the surface of the photoreceptor, and a transferer configured to transfer the toner image onto a transfer material;

wherein the photoreceptor comprises:

an electroconductive substrate, and a photosensitive layer located overlying the electroconductive substrate, comprising a charge generation material and a charge transport material, wherein the charge transport material has the following formula (1):

(1)

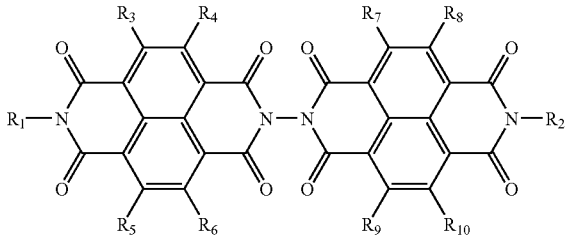

wherein R1 and R2 independently represent a hydrogen atom, or a group selected from the group consisting of substituted and unsubstituted alkyl groups, substituted and unsubstituted cycloalkyl groups, and substituted and unsubstituted aralkyl groups; and R3, R4, R5, R6, R7, R8, R9, and R10 independently represent a hydrogen atom, a halogen atom, or a group selected from the group consisting of cyano groups, nitro groups, amino groups, hydroxyl groups, substituted and unsubstituted alkyl groups, substituted and unsubstituted cycloalkyl groups, and substituted and unsubstituted aralkyl groups, wherein the transferer comprises:

an intermediate transferer, wherein after the toner image is primarily transferred onto the intermediate transferer, the toner image is secondarily transferred onto a recording material, and wherein the intermediate transferer comprises a belt, and the toner image formed on the photoreceptor is transferred onto said belt by a first transferrer located inside said belt.

6. The electrophotographic image forming apparatus according to claim 5, wherein the charge generation material is phthalocyanine.

7. The electrophotographic image forming apparatus according to claim 5, wherein the photoreceptor is positively charged.

8. The electrophotographic image forming apparatus according to claim 5, further comprising a plurality of the photoreceptors, wherein one-color toner images developed on each of the photoreceptors are overlaid in order to form color images.

9. An electrophotographic image forming apparatus, comprising:

a photoreceptor, a charger configured to charge the surface of the photoreceptor, an irradiator configured to irradiate the surface of the photoreceptor with imagewise light to form an electrostatic latent image thereon, at least one image developer configured to develop the electrostatic latent image with a developer comprising a toner to form a toner image on the surface of the photoreceptor, and a transferer configured to transfer the toner image onto a transfer material;

wherein the photoreceptor comprises:

an electroconductive substrate, and a photosensitive layer located overlying the electroconductive substrate, comprising a charge generation material and a charge transport material, wherein the charge transport material has the following formula (1):

(1)

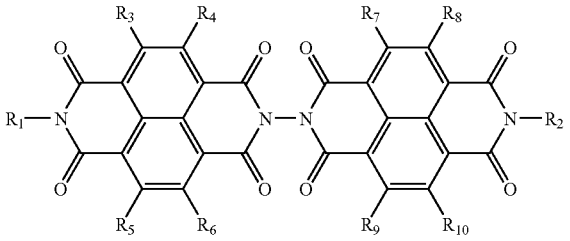

wherein R1 and R2 independently represent a hydrogen atom, or a group selected from the group consisting of substituted and unsubstituted alkyl groups, substituted and unsubstituted cycloalkyl groups, and substituted and unsubstituted aralkyl groups; and R3, R4, R5, R6, R7, R8, R9, and R10 independently represent a hydrogen atom, a halogen atom, or a group selected from the group consisting of cyano groups, nitro groups, amino groups, hydroxyl groups, substituted and unsubstituted alkyl groups, substituted and unsubstituted cycloalkyl groups, and substituted and unsubstituted aralkyl groups, wherein the irradiator comprises a light emitting diode as the imagewise light source.

10. The electrophotographic image forming apparatus according to claim 9, wherein the charge generation material is phthalocyanine.

11. The electrophotographic image forming apparatus according to claim 9, wherein the photoreceptor is positively charged.

12. The electrophotographic image forming apparatus according to claim 9, further comprising a plurality of the photoreceptors, wherein images developed on the plurality of photoreceptors are transferred and overlaid in order.

* * * * *